US007921000B2

(12) United States Patent
Ohkura et al.

(10) Patent No.: US 7,921,000 B2
(45) Date of Patent: Apr. 5, 2011

(54) MAINTENANCE SUPPORT SYSTEM FOR CONSTRUCTION MACHINE

(75) Inventors: Yasunori Ohkura, Hiratsuka (JP); Hirobumi Miwa, Hiratsuka (JP); Masakazu Kawakita, Tokyo (JP); Takahiro Yoshimura, Tokyo (JP)

(73) Assignee: Komatsu Ltd., Tokyo (JP)

( * ) Notice: Subject to any disclaimer, the term of this patent is extended or adjusted under 35 U.S.C. 154(b) by 767 days.

(21) Appl. No.: 11/587,917

(22) PCT Filed: Apr. 27, 2005

(86) PCT No.: PCT/JP2005/007958

§ 371 (c)(1),
(2), (4) Date: Dec. 27, 2007

(87) PCT Pub. No.: WO2005/106139

PCT Pub. Date: Nov. 10, 2005

(65) Prior Publication Data

US 2008/0195365 A1 Aug. 14, 2008

(30) Foreign Application Priority Data

Apr. 28, 2004 (JP) ..... 2004-133496

(51) Int. Cl.
*G06F 9/455* (2006.01)

(52) U.S. Cl. ..... 703/7; 701/29; 702/182; 702/184

(58) Field of Classification Search ..... 703/6, 7; 705/1, 8, 26; 702/182, 34, 33, 61, 184, 183; 701/29, 35, 50; 700/95, 96, 175, 99; 707/200; 235/376; 714/43; 62/141; 123/673
See application file for complete search history.

(56) References Cited

U.S. PATENT DOCUMENTS 5,216,612 A * 6/1993 Cornett et al. ..... 700/96
5,754,965 A * 5/1998 Hagenbuch ..... 701/35
5,819,714 A * 10/1998 Bush et al. ..... 123/673
5,952,587 A * 9/1999 Rhodes et al. ..... 73/862.541
6,199,018 B1 * 3/2001 Quist et al. ..... 702/34
6,542,853 B1 * 4/2003 Murakami et al. ..... 702/183

(Continued)

FOREIGN PATENT DOCUMENTS

JP 2002188183 A 7/2002

(Continued)

OTHER PUBLICATIONS

Mitchell, Z.W, "A statistical analysis of construction equipment repair costs using field data & the cumulative cost model", Virginia Polytechnique Institute and State University, 1998.*

(Continued)

*Primary Examiner* — Kandasamy Thangavelu
(74) *Attorney, Agent, or Firm* — Westerman, Hattori, Daniels & Adrian, LLP

(57) ABSTRACT

A maintenance support system for a construction machine calculates the cumulative load of every component corresponding with the driving and working conditions of the construction machine by a load calculation means after simulating the driving and working conditions on the basis of production operating conditions by an operation simulation means, and forecasts the lifespan of the respective components by a lifespan calculation means on the basis of the cumulative load. Hence, a more accurate maintenance schedule can be established in comparison with a case where which component is to be maintained is determined on the basis of only the operating time.

9 Claims, 27 Drawing Sheets

U.S. PATENT DOCUMENTS

| | | | | |
|---|---|---|---|---|
| 7,096,156 | B2 * | 8/2006 | Hosaka et al. | 702/182 |
| 2002/0013639 | A1 * | 1/2002 | Fujishima et al. | 700/175 |
| 2002/0035457 | A1 * | 3/2002 | Brown | 703/6 |
| 2002/0120412 | A1 * | 8/2002 | Hayashi et al. | 702/61 |
| 2002/0173970 | A1 * | 11/2002 | Hamada | 705/1 |
| 2003/0055666 | A1 * | 3/2003 | Roddy et al. | 705/1 |
| 2003/0115020 | A1 * | 6/2003 | Adachi et al. | 702/184 |
| 2003/0192328 | A1 * | 10/2003 | Kikuchi et al. | 62/141 |
| 2004/0049715 | A1 * | 3/2004 | Jaw | 714/43 |
| 2004/0148230 | A1 * | 7/2004 | Matsui et al. | 705/26 |
| 2004/0267395 | A1 * | 12/2004 | Discenzo et al. | 700/99 |
| 2005/0021245 | A1 * | 1/2005 | Furuno et al. | 702/33 |
| 2009/0259507 | A1 * | 10/2009 | Miwa et al. | 705/8 |

FOREIGN PATENT DOCUMENTS

| | | | |
|---|---|---|---|
| JP | 2003-119831 | A | 4/2003 |
| JP | 2003-140743 | A | 5/2003 |
| JP | 2004-046550 | A | 2/2004 |
| JP | 2004-62675 | A | 2/2004 |

OTHER PUBLICATIONS

Perdomo, J.L., "Detailed haul unit performance model", Virginia Polytechnique Institute and State University, 2001.*

International Search Report of PCT/JP2005/007958 date of mailing Aug. 23, 2005.

* cited by examiner

FIG. 7

126

PRODUCTION CONDITIONS → COURSE CONDITIONS → MACHINE CONDITIONS → FLEET CONDITIONS → SECTION TIME → SIMULATION CONDITIONS >

SECTION TIME (SECONDS)

COURSE NAME SAMPLE_2L_ID

DUMP TRUCK HD465-1

SITE ELEVATION

CONFIRM TERRAIN

| CLASSIFICATION AS OUTWARD OR RETURN TRIP | CLASSIFICATION | | CLASSIFICATION | DISTANCE | AVERAGE SPEED (km/h) | | SECTION TIME (SECONDS) | |
|---|---|---|---|---|---|---|---|---|
| | | | | | OUTWARD TRIP | RETURN TRIP | OUTWARD TRIP | RETURN TRIP |
| I | 1 | ... | N | 79 | 19.47 | 19.47 | 14.60 | 14.92 |
| I | 2 | ... | N | 79 | 25.00 | 25.00 | 11.38 | 11.38 |
| I | 3 | ... | N | -300 | 30.00 | 36.00 | 36.00 | 36.00 |
| I | 4 | ... | N | -500 | 27.93 | 28.02 | 64.44 | 64.25 |
| I | 3 | ... | N | 200 | 26.87 | 27.90 | 26.80 | 25.81 |

BACK

NEXT

FIG. 15

133

| SEVERITY | | LIGHT LOAD | | | MEDIUM LOAD | HEAVY LOAD | |
|---|---|---|---|---|---|---|---|
| NATURE OF WORK AND LOAD LEVEL | a. SIZE OF LOAD (DREDGING TIME:SEC) | PRODUCT DREDGING NO MORE THAN 6 SECONDS | TRANSPORTATION NO MORE THAN 7 TO 9 SECONDS | DREDGING OF EXPLODED FALLEN ROCK NO MORE THAN 6 SECONDS | DREDGING AND LOADING OF EXPLODED FALLEN ROCK 7 TO 9 SECONDS | GROUND DREDGING AND LOADING(INCLUDING ROOT CUTTING WORK) AT LEAST 10 SEC | NATURE OF WORK |
| | COEFFICIENT | ① 0.9 | ② 0.95 | ③ 0.9 | ④ 1.0 | ⑤ 1.05 | |
| | | | | | MR A : 1.025 | | |
| | b.BIAS WEIGHT | SAND, GRAVEL NO MORE THAN 50 mm | | MEDIUM STONE 150 TO 300 mm | | LARGE STONE AT LEAST 300 mm | TARGET |
| | COEFFICIENT | ① 0.9 | | ② 1.0 | | ⑤ 1.05 | |
| | | | | | MR A : 1.025 | | |
| | c. LOAD FREQUENCY | L&C WORK (CYCLE TIME: 60 UPWARD) | DUMP TRUCK LOADING (CYCLE TIME: 45 TO 55 SEC) | | DUMP TRUCK LOADING (CYCLE TIME: <35 SEC) | DUMP TRUCK LOADING (CYCLE TIME: <35 SEC) | CYCLE TIME FUEL PROPERTIES |
| | COEFFICIENT | ① 0.9 | ② 0.95 | | ③ 1.0 | ④ 1.05 | |
| | | | | | (MR. A: 1.0) | | |
| LOAD LEVEL ACCORDING TO VEHICLE APPLICATION | b. VEHICLE WEIGHT 1. PACKET IMPROVEMENT 2. ADD WEIGHT/CALCIUM CHLORIDE 3. DIAMOND CHAIN | STD VEHICLE (ACTUAL VEHICLE WEIGHT < STD VEHICLE WEIGHT_1.03) | | INCREASED VEHICLE WEIGHT (STD VEHICLE WEIGHT_1.03< ACTUAL VEHICLE WEIGHT STD WEIGHT_1.1) | NCREASED VEHICLE WEIGHT (ACTUAL LOADED VEHICLE WEIGHT> STD VEHICLE WEIGHT_1.1) | | VEHICLE WEIGHT IN LOADED STATE (MR. A DEBT INCREASE PACKET FILL RATE 110%) |
| | COEFFICIENT | ① 1.0 | | ② 1.05 | | ③ 1.1 | |
| | | | | (MR. A: 1.05) | | | |
| SEVERITY | COMBINATION EXAMPLE | a①,b①,c①,d① | a②,b①,c①,d① | a②,b①,c②,d① | a②,b②,c②,d② | a④,b②,c③,d② | a④,b②,c③,d③ | a⑤,b③,c④,d③ | |
| PRODUCT OF COEFFICIENTS (axbxcxd) | | 0.73 | 0.77 | 0.81 | 0.9 | 1.05 | (MR. A: 1.103) 1.10 | 1.27 | |
| LIFESPAN RATIO | | 120 | | | 1.00 | | 90.00 | 80 | |

FIG. 18
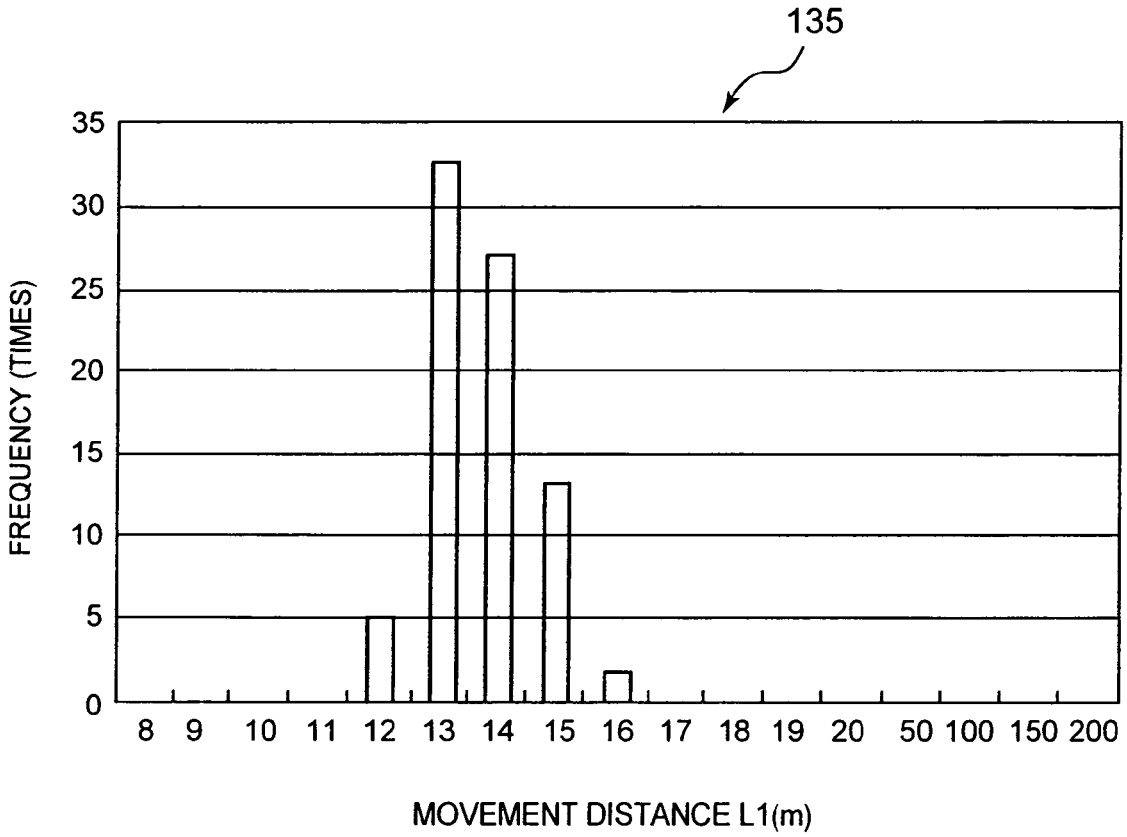
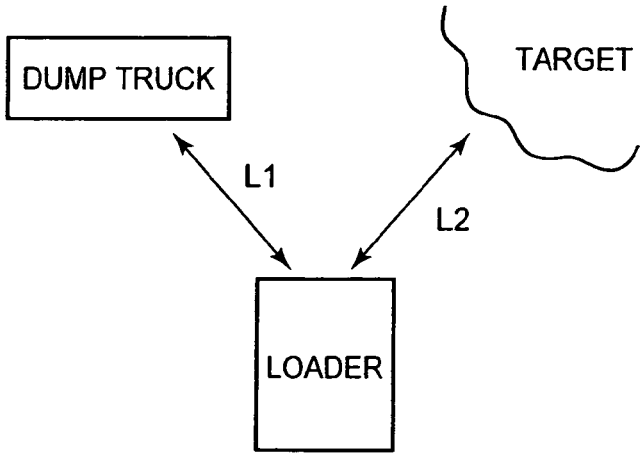

MAINTENANCE SUPPORT SYSTEM FOR CONSTRUCTION MACHINE

TECHNICAL FIELD

The present invention relates to a maintenance support system for a construction machine.

BACKGROUND ART

In recent years, a system that acquires information relating to the operating time of construction machines by means of wireless communications and, when the cumulative operating time reaches a maintenance period decided by the maintenance schedule, prompts the user to maintain the component corresponding to the maintenance period has bee proposed (Japanese Patent Application Laid Open No. 2003-119831). That is, with this maintenance schedule, the decision on which component is to be maintained is made in accordance with the cumulative operating time of the construction machine.

Further, according to Japanese Patent Application Laid Open No. 2003-119831 above, a multiplicity of sensor types that detect the operating states of the respective principal components are installed in a construction machine and, when it is judged that an anomaly has occurred with a component, maintenance of the component can be performed independently of the maintenance schedule.

However, when the operating site of the construction machine is overseas, for example, if components are obtained after being judged to be abnormal, there is the possibility of the user's work schedule being hindered. In addition, because airmail must be used for a timely supply of the component, there is the problem that shipping costs increase greatly.

Hence, the lifespan is forecast before the component is abnormal and a servicing schedule according to which timely maintenance is performed and an arrangement schedule for supply components are desirably established.

Furthermore, when the driving and work and so forth of a construction machine are performed under more rigorous conditions than those first forecast, an anomaly of a component is produced sooner than the maintenance period of the standard maintenance schedule. In this case, maintenance is required sooner than the initial maintenance schedule. Therefore, when a manufacturer fulfils a maintenance contract (a maintenance contract that is exchanged between the manufacturer of the construction machine and the customer who is the user (owner)), the manufacturer then performs maintenance at a higher frequency than initially planned. As a result, this means excessive costs for the manufacturer.

Hence, the accuracy of maintenance schedules such as the servicing schedule for each component and the arrangement schedule for the supply components is essential and a suitable maintenance contract is desirably established based on a highly accurate maintenance schedule.

DISCLOSURE OF THE INVENTION

An object of the present invention is to provide a maintenance support system for a construction machine that permits an improvement of the accuracy of a maintenance schedule for the construction machine.

A further object of the present invention is to provide a maintenance support system for a construction machine that allows a maintenance schedule for the construction machine to be accurately created by considering the actual operating condition of the construction machine.

A maintenance support system for a construction machine according to claim 1 of the present invention is a maintenance support system for a construction machine that comprises a computer system that can be connected to a construction machine via a communication network, wherein the computer system comprises: operation simulation means for simulating the driving conditions and/or working conditions of the construction machine on the basis of production operating conditions that are input; cumulative load calculation means for predictively calculating a cumulative load (severity) relating to a predetermined component that is preset, on the basis of the simulation results; and lifespan calculation means for calculating the lifespan of the predetermined component on the basis of the cumulative load.

A maintenance support system for a construction machine according to claim 2 of the present invention is a maintenance support system for a construction machine that comprises a computer system that can be connected to a construction machine via a communication network, wherein the computer system comprises: cumulative load calculation means for calculating a cumulative load of a predetermined component on the basis of the operation information of the construction machine; and lifespan calculation means for calculating the lifespan of the predetermined component on the basis of the cumulative load.

A maintenance support system for a construction machine according to claim 3 of the present invention is a maintenance support system for a construction machine according to claim 2, wherein the computer system comprises operation simulation means for simulating the driving conditions and/or working conditions of the construction machine on the basis of production operating conditions; the cumulative load calculation means is provided capable of calculating, by means of a predetermined calculation algorithm, the cumulative load of the predetermined component, on the basis of both the simulation results or the operation information; and cumulative load comparison means for comparing a cumulative load based on the simulation result and a cumulative load based on the operation information, and load calculation algorithm modification means for changing the calculation algorithm on the basis of the result of the comparison, are provided.

A maintenance support system for a construction machine according to claim 4 of the present invention, wherein the operation simulation means sets, for respective simulation models, a departure point of the construction machine, an arrival point of the construction machine, and at least one course that links the departure and arrival points, each being designated by the production operating conditions, in order to simulate, at predetermined times, the driving conditions and/or working conditions of the construction machine in accordance with the occurrence status of events associated with the departure point, arrival point, and course respectively.

A maintenance support system for a construction machine according to claim 5 of the present invention is the maintenance support system for a construction machine according to claim 4, wherein the operation simulation means sets a plurality of event nodes on the course, and produces events for the respective event nodes in consideration of traffic regulations and traffic amounts between the respective event nodes.

A maintenance support system for a construction machine according to claim 6 of the present invention is the maintenance support system for a construction machine according to any one of claims 1 to 3, wherein the cumulative load calculation means calculates the relationship between the cumulative load and operation time relating to the predetermined component.

A maintenance support system for a construction machine according to claim 7 of the present invention is the maintenance support system for a construction machine according to any one of claims 1 to 3, wherein the lifespan calculation means predictively calculates the lifespan of the predetermined component on the basis of a standard lifespan that is preset for the predetermined component and the result of the calculation by the cumulative load calculation means.

A maintenance support system for a construction machine according to claim 8 of the present invention is the maintenance support system for a construction machine according to claim 3, wherein the cumulative load calculation means calculates the relationship between the cumulative load and operating time relating to the predetermined component; the cumulative load comparison means finds a maximum value of the cumulative load based on the simulation results and a maximum value of the cumulative load based on the operation information, detects the respective operating times corresponding with the maximum values, and calculates and outputs the ratio between the respective operating times thus detected; the load calculation algorithm modification means corrects the calculation algorithm so that the difference between the cumulative load based on the simulation result and the cumulative load based on the operation information is small on the basis of the ratio between the respective operating times calculated by the cumulative load comparison means.

A maintenance support system for a construction machine according to claim 9 of the present invention is a maintenance support system that comprises a plurality of construction machines each of which can be connected to a communication network and a computer system that can be connected to the communication network, wherein the respective construction machines comprise a plurality of sensors for detecting the operating states of the respective components; an operation information generation section for statistically processing information that is detected by the respective sensors and outputting same as operation information; and a communication section for transmitting the operation information output from the operation information generation section to the computer system via the communication network, wherein the computer system comprises: an operation information database that accumulates the operation information that is received from the communication section via the communication network; a component standard lifespan database in which the standard lifespan of the respective components are accumulated beforehand; a simulation results database for accumulating simulation results; an input section for inputting production operating conditions of the respective construction machines; an operation simulation section for individually simulating the driving conditions and/or working conditions of the respective construction machines by setting the production operating conditions input via the input section in the simulation model, and storing the simulation results in the simulation results database; a cumulative load calculation section for calculating, in accordance with a predetermined calculation algorithm, the cumulative load relating to the respective components on the basis of both the operation information stored in the operating information database and the simulation results stored in the simulation results database; a lifespan calculation section for calculating the lifespan of the respective components on the basis of the cumulative load thus calculated and the component standard life database; a cumulative load calculation section for comparing the cumulative load calculated on the basis of the simulation results and the cumulative load calculated on the basis of the operation information; and a load calculation algorithm modification section for modifying the calculation algorithm on the basis of the result of the comparison by the cumulative load calculation section.

According to the invention of claim 1 hereinabove, after the driving conditions and/or operating conditions of the construction machine have been simulated by the simulation means on the basis of the production operating conditions, the cumulative load of each component that corresponds with the driving conditions and/or operating conditions is calculated by the cumulative load calculation means and the lifespan of each component is calculated by the lifespan calculation means on the basis of the cumulative load. Hence, a more accurate maintenance schedule can be established in comparison with a case where the maintenance schedule is based only on the operating time as in the prior art. Hence, the possibility of a component anomaly occurring at an earlier stage than the expected lifespan can be reduced. Therefore, because a component may be transported to the operating site in accordance with the initial maintenance schedule, urgent transportation such as airmail can be avoided, transit via surface mail can be used and transportation costs can be reduced.

In addition, because the accuracy of the components maintenance schedule is favorable and the possibility of unexpected components repairs or exchanges can be reduced, there is no need to perform work that departs greatly from the maintenance schedule and maintenance costs can be reduced.

According to the invention of claim 2, the cumulative load of each component is calculated at predetermined times by means of cumulative load calculation means on the basis of the actual operation information of the construction machine and the lifespan calculation means calculate the latest lifespan of each component on the basis of the cumulative load. Hence, the reliability of the maintenance schedule can be increased further on the basis of the forecast of the latest lifespan.

The cumulative load calculated by the simulation prior to the operation of the construction machine and the actual cumulative load can be different for whatever reason. Hence, according to the invention of claim 3, in such a case, the cumulative load comparison means starts up and judges the difference between the respective cumulative loads and prompts modification of the algorithm that associates the production operating conditions during simulation and the cumulative load by the algorithm modification means. Thus, the accuracy of the maintenance schedule is increased further as a result of further increasing the accuracy of the simulation.

According to the invention of claim 4, the driving conditions and/or the operating conditions of the construction machine can be simulated at predetermined times on the basis of the occurrence status of the respective events that exist between the departure of the construction machine and the arrival thereof at the intended destination. Therefore, by adopting a simulation of such an event-driven system, the behavior of a plurality of construction machines can be simulated in real time by means of a comparatively simple constitution.

According to the invention of claim 5, more accurate simulation results can be obtained by considering the traffic regulations and traffic amount between a plurality of event nodes that are set for the course.

According to the invention of claim 6, the cumulative load calculation means calculates the relationship between the cumulative load and operating time relating to a predetermined component and the lifespan of the component can therefore be indicated by means of time information.

According to the invention of claim 7, the lifespan calculation means is able to predictively calculate the lifespan of a predetermined component on the basis of the standard lifespan preset for the predetermined component and the calculation result obtained by the cumulative load calculation means.

According to the invention of claim 8, a calculation algorithm can be corrected by means of a comparatively simple constitution so that the difference between the cumulative load based on the simulation result and the cumulative load based on the operation information is small.

BRIEF DESCRIPTION OF THE DRAWINGS

FIG. 7 shows an input screen for section times;

FIG. 15 shows a cumulative load computation table;

FIG. 18 shows a movement distance frequency map;

BEST MODE FOR CARRYING OUT THE INVENTION

An embodiment of the present invention will be described hereinbelow with reference to the drawings.

Figure 1:
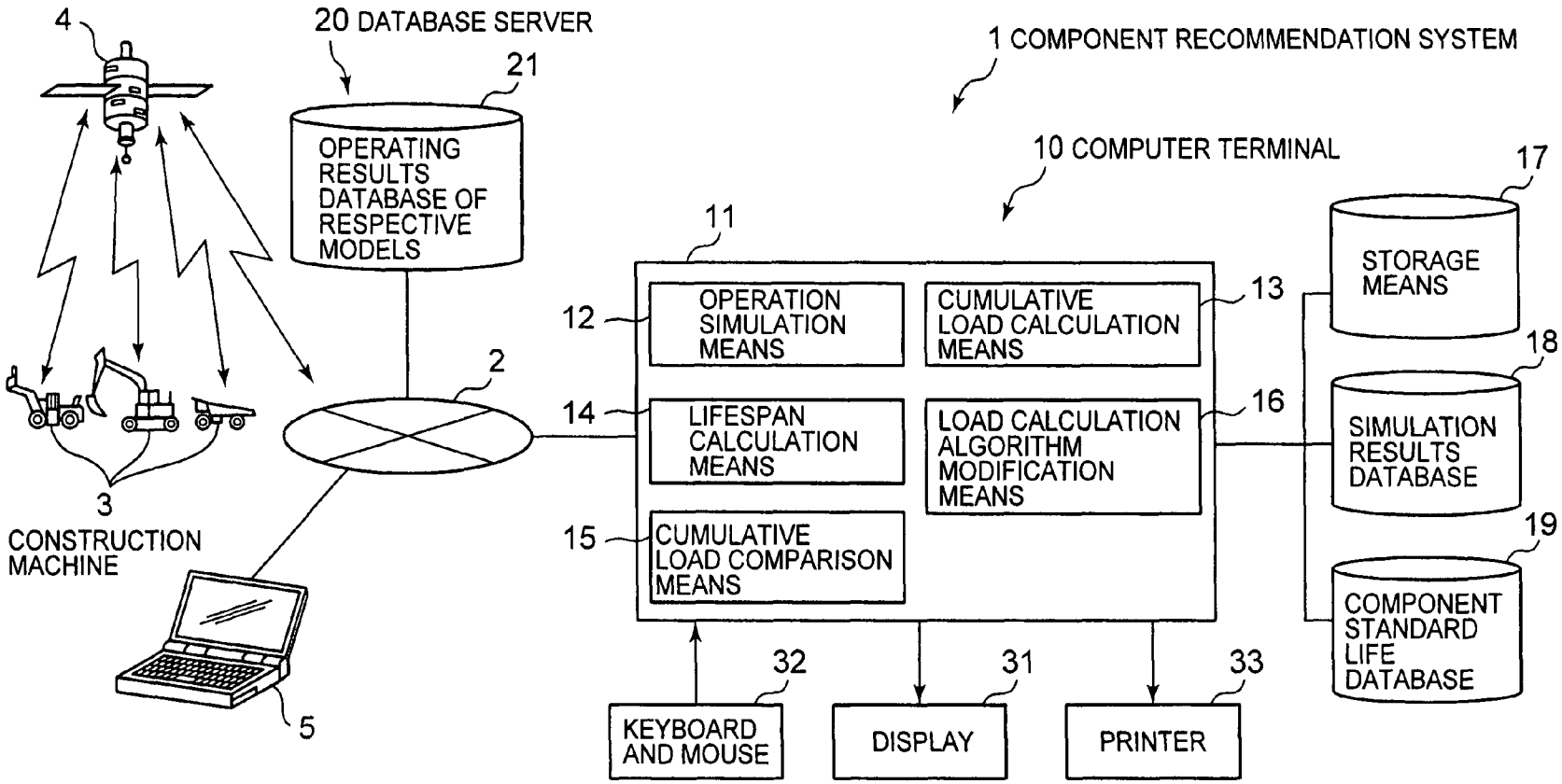
FIG. 1 is a block diagram of a computer terminal for implementing a maintenance support system for a construction machine according to a first embodiment of the present invention.

FIG. 1 shows the overall constitution of a component recommendation system 1 of the maintenance support system for a construction machine according to this embodiment.

First Embodiment

Overall Constitution of System

The component recommendation system 1 can be used to allow the construction machine manufacturer to make a variety of propositions to the customer who is a mine developer before mine development and so forth, for example. For example, the construction machine manufacturer is able to simulate and advocate a fleet configuration that satisfies the production operating conditions of the customer by using the system 1. A fleet configuration signifies a configuration of a construction machine group that is formed in order to achieve a certain objective. Further, the construction machine manufacturer is able to present the customer with information relating to a maintenance schedule for components required for a maintenance contract when a construction machine is purchased (servicing schedule, supply arrangement schedule and so forth) by using the system 1. In addition, the construction machine manufacturer is able to update the maintenance schedule to the latest state by forecasting the optimum exchange period of the components of the construction machine by using the system 1 after the mine development has started.

A general personal computer, for example, can be used as the computer terminal 10 for constructing at least a portion of the component recommendation system 1. For example, the computer terminal 10 can be used independently at the stage where a fleet configuration is proposed by the construction machine manufacturer. Further, after the start of mine development, for example, work and so forth to review the maintenance schedule can be performed by connecting the computer terminal 10 and a database server 20 (at the manufacturer) via a communication network 2 such as the Internet. The computer terminal 10 will be described in detail at a later stage.

The database server 20 is a device for acquiring operation information from a construction machine 3 and storing the operation information in an operating results database 21 for each respective machine.

A loading machine such as a loader or hydraulic shovel or the like or a transport machine such as a dump truck or the like that operates at a mining development site, for example, can be proposed as the construction machine 3.

The operation information can be transmitted directly to from the respective machines 3 to the database server 20 via a communication satellite 4 and the communication network 2. In addition, after operation information has been downloaded from the respective machines 3 to another computer terminal 5, for example, the operation information can sometimes also be transmitted from the computer terminal 5 to the database server 20 via the communication network 2.

To this end, the construction machine 3 is provided with a variety of means such as means for generating the operation information, means for transmitting the generated operation information to the database server 20, or means for downloading the operation information to the computer terminal 5.

Figure 16:
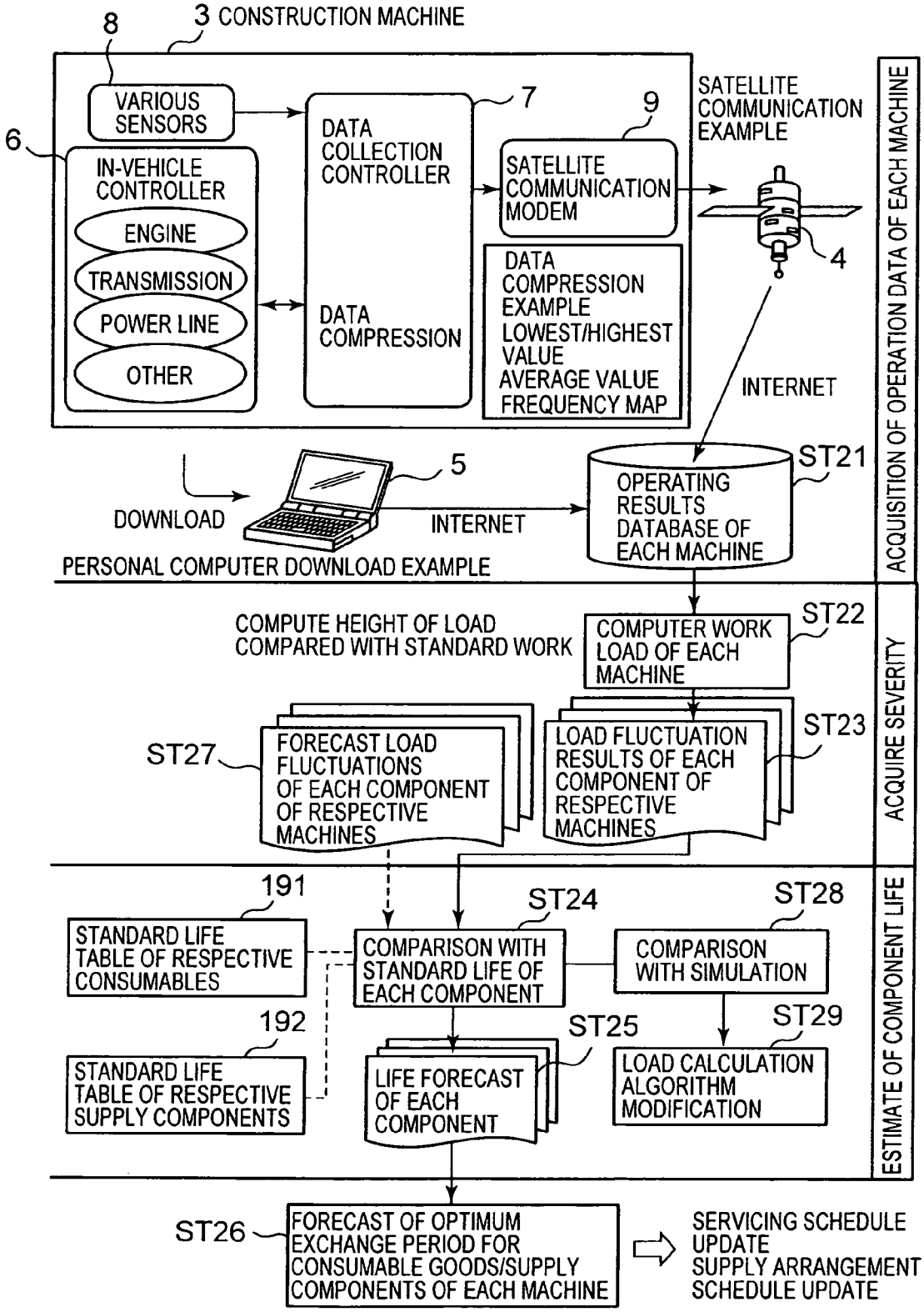
FIG. 16 is a flowchart showing the flow of a component lifespan calculation based on the actual operating information.

These means are specifically shown schematically in FIG. 16. That is, the construction machine 3 comprises an engine, a transmission, a power line and an in-vehicle controller 6 for controlling the other components. The vehicle-mounted controller 6 outputs operation information acquired from each of the components to a data collection controller 7. Operation information for the engine, for example, can include the amount of fuel consumed and, for the transmission, can include the transmission speed.

In addition, the construction machine 3 is provided with a variety of sensors 8 for detecting the engine speed of the engine, lubricating oil temperature, water temperature, blow-by pressure, and exhaust temperature and so forth and for detecting the amount of clutch wear of the transmission, the output torque, and the operating oil temperature, for example, and so forth. The data detected from the various sensors 8 are also output to the data collection controller 7 as operation information. Further, other operation information includes, for example, the operating time, cycle time, movement distance, excavation time, and maximum vehicle speed and so forth.

Further, the operating information collected by the data collection controller 7 can be optionally compressed. For example, various operation information can be statistically processed such as minimum values, maximum values, and average values. Further, maps and trends and so forth can be constructed by combining suitable operation information. The operation information processed in this way is transmitted from a satellite communication modem 9 to a communication satellite 4 or downloaded to the terminal 5 and accumulated in the operating results database 21. Map types and so forth will be described subsequently.

Computer Terminal

Returning now to FIG. 1, the computer terminal 10 comprises a computation processing device 11 that develops various programs on an OS (Operating System) that performs operational control of the terminal 10. Programs that are developed on the OS can include operation simulation means 12, cumulative load calculation means 13, lifespan calculation means 14, cumulative load comparison means 15, and load calculation algorithm modification means 16 and so forth.

Further, in addition to storage means 17 in which the respective programs 12 to 16 are stored, the computer terminal 10 is provided with a simulation results database 18 that accumulates the results of operation simulation and a component standard lifespan database 19 in which the standard lifespans obtained from design values for the respective components and so forth are accumulated as a standard life table.

The operation simulation means 12 has a function for performing a simulation of the driving and working conditions of the construction machine 3 by optionally selecting production operating conditions such as course conditions on site, machine conditions, fleet conditions, section times, and simulation conditions, for example, in addition to the production conditions presented by the customer. As a result of the simulation, simulation results produced by collecting the individual costs for the recommended construction machines 3, the costs of the construction machines 3 of the whole fleet, and the work time and rest time of the construction machines 3 of the fleet can be obtained. In addition, the operating conditions of the respective construction machines 3 can be displayed by means of animation videos on the basis of the simulation results.

Further, the construction machine manufacturer negotiates with the customer on the basis of the information on costs obtained as a result of the simulation and facilitates the sales of the recommended construction machines. That is, the operation simulation means 12 can be used as a business tool of the construction machine manufacturer with respect to customers intending to perform mine development and so forth. The specific procedure for the simulation by the operation simulation means 12 will be described subsequently.

The cumulative load calculation means 13 calculates the severity of the cumulative load of each component on the basis of the simulation results at the stage of negotiations with the customer. Further, the cumulative load calculation means 13 has a function for calculating the severity of the respective components on the basis of the actual operation information acquired from the construction machine 3 after the actual mine development and so forth has started.

The lifespan calculation means 14 forecasts and calculates the lifespan of each component on the basis of the severity calculated by the cumulative load calculation means 13. The lifespan that is predictively calculated can be used to forecast the optimum exchange period for consumable goods and reinforcement components and so forth. In addition, the information of the optimum exchange period can be used in drafting a maintenance schedule such as a servicing schedule and an arrangement schedule for reinforcement components. Further, a maintenance schedule is advantageous in tying up a maintenance contract for the construction machine 3 being sold at the stage of negotiation with the customer and is used to actually fulfill the maintenance contract after the mine development has started.

That is, in this embodiment, the lifespan is forecast in accordance with the severity of the individual components by means of the lifespan calculation means 14 and cumulative load calculation means 13. Further, in this embodiment, the exchange period and so forth for each component is determined on the basis of each of the forecast lifespans. In this respect, this technology differs from the conventional technology in which the component exchange period is determined in accordance with the cumulative operating time of the construction machine 3 alone.

The cumulative load comparison means 15 has a function for comparing the severity calculated on the basis of the simulation results and the severity calculated on the basis of the operation information based on the actual driving and working conditions and so forth. By comparing the two degrees of severity of the respective components which are the subject of the maintenance schedule, components for which the two degrees of severity differ greatly can be determined. Further, because the component lifespan also comes to be different for components for which there is a difference between the severity forecast prior to the operation of the construction machine 3 and the actual severity calculated after the operation of the construction machine 3, an update to correct the maintenance schedule is carried out. Further, the production operating conditions relating to the components during a simulation can be verified on the basis of the difference between the respective degrees of severity of a specified component and the algorithm when the severity is calculated can be verified from the simulation results or operation information.

For example, the brake pads of a loader will now be taken as an example. It can be considered that the production operating conditions used during the simulation differ greatly from the actual operating conditions, for example, when the result is that the severity of the brake pads calculated on the basis of the operation information is more severe than the severity forecast by the simulation. An example is a case where the value of the speed of movement of the load during loading differs greatly from the actual value during the simulation. This is because, when the actual speed of movement is larger than the input value during simulation, the decreasing condition of the brake pads accelerates. The result of such a comparison is used to determine a more accurate input value when the next simulation is performed.

Further, such an input value is determined artificially on the basis of the predetermined standard value. However, a predetermined arithmetic expression or the like is used to calculate the severity from the simulation results or operation information. Hence, as mentioned earlier, when an error occurs with the result of the comparison of the severity of the brake pads, this arithmetic expression is suspect in cases where the input value for the speed of movement that is artificially determined as a result of verification of the production operating conditions is substantially the same as the actual speed of movement.

Therefore, the load calculation algorithm modification means 16 is provided in this embodiment.

The load calculation algorithm modification means 16 has a function for prompting modification of the coefficients and so forth in the arithmetic expression when it is judged that the cause of the error with the severity comparison result lies with the arithmetic expression when the severity is calculated. Accordingly, because the arithmetic expression is corrected to a more accurate expression, the value of the severity is also accurate and the accuracy of the result of the calculation of the lifespan as well as that of the maintenance schedule that is established based on the lifespan calculation also improve.

Simulation Procedure

The specific simulation procedure when the operation simulation means 12 is started up will be described hereinbelow with reference to FIGS. 2 to 13.

Figure 2:
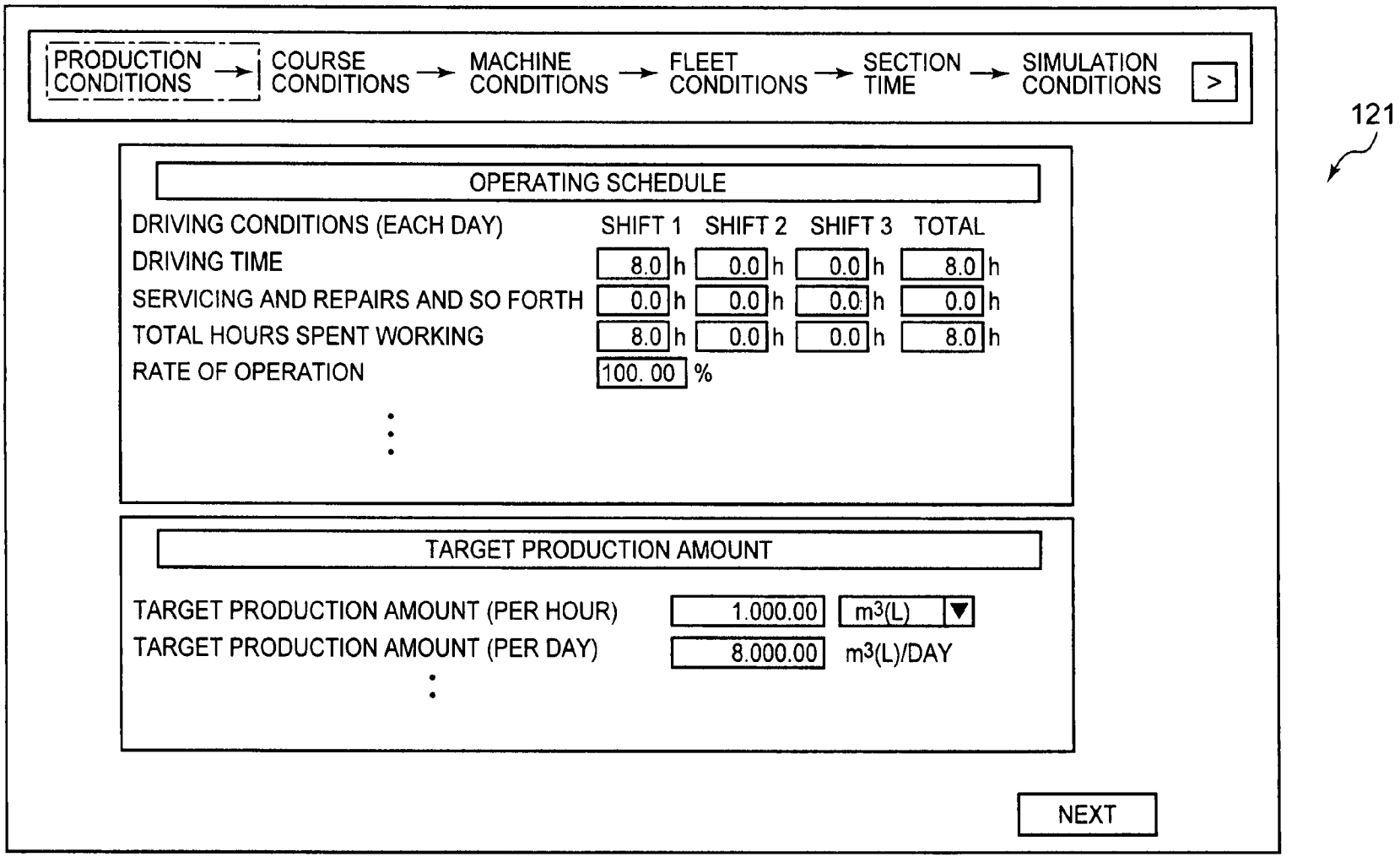
FIG. 2 shows an input screen for production conditions.
Figure 3:
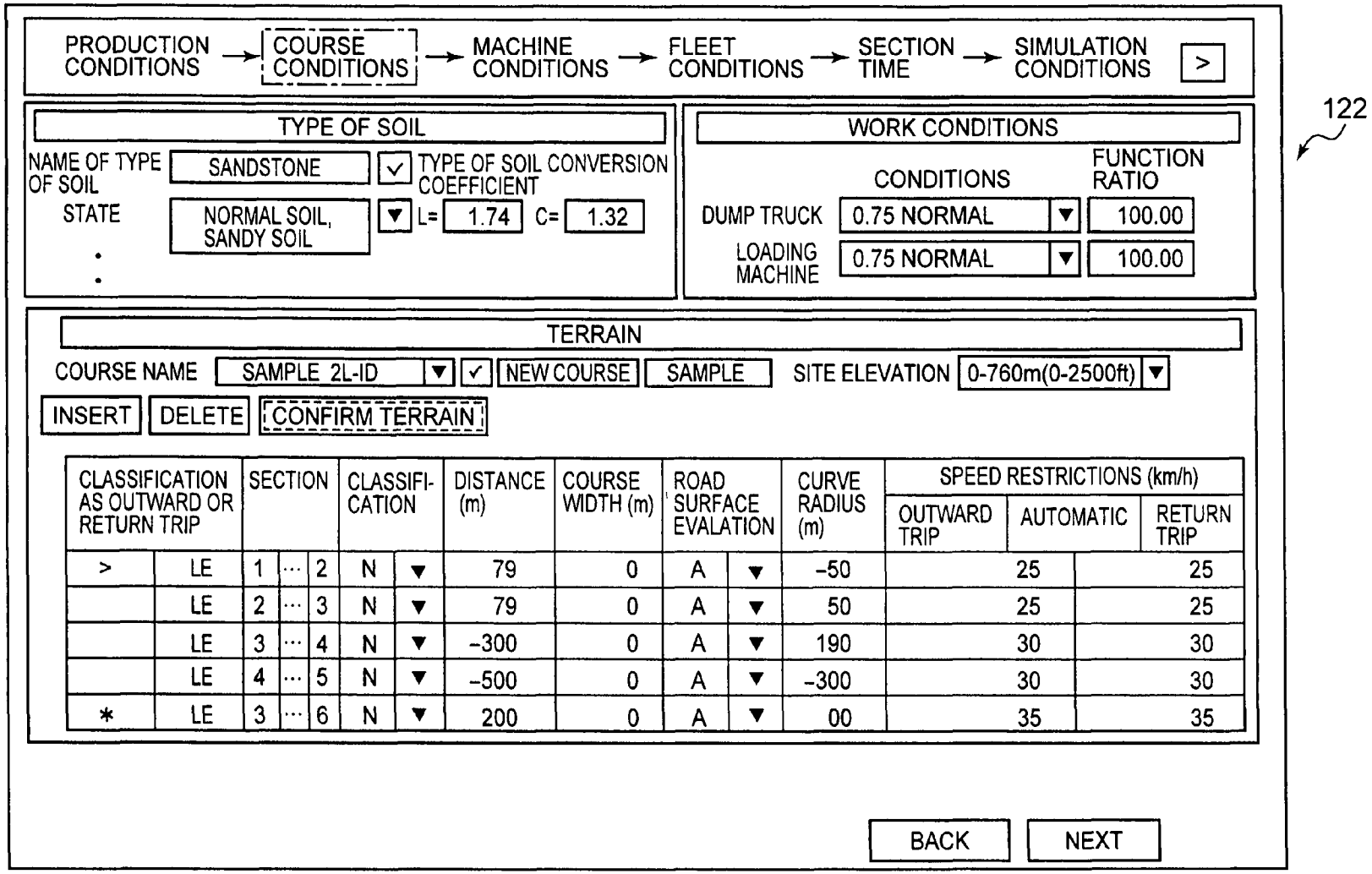
FIG. 3 shows an input screen for course conditions.

When the operation simulation means 12 constituting a simulation program is started up, a production condition input screen 121 such as that shown in FIG. 2 is first displayed on the display 31 of the terminal 10. In the production condition input screen 121, information relating to a production schedule such as the operating schedule and the target production amount scheduled on the customer side are input as the production conditions. Information relating to the operating schedule can include, for example, the driving time each day, servicing and repair time, the total hours spent working by the operator, and the rate of operation, and so forth. The target production amount can include, for example, the target production amount per hour and the target production amount per day, and so forth. The inputting of these values can be performed by a keyboard and mouse 32.

Figure 4:
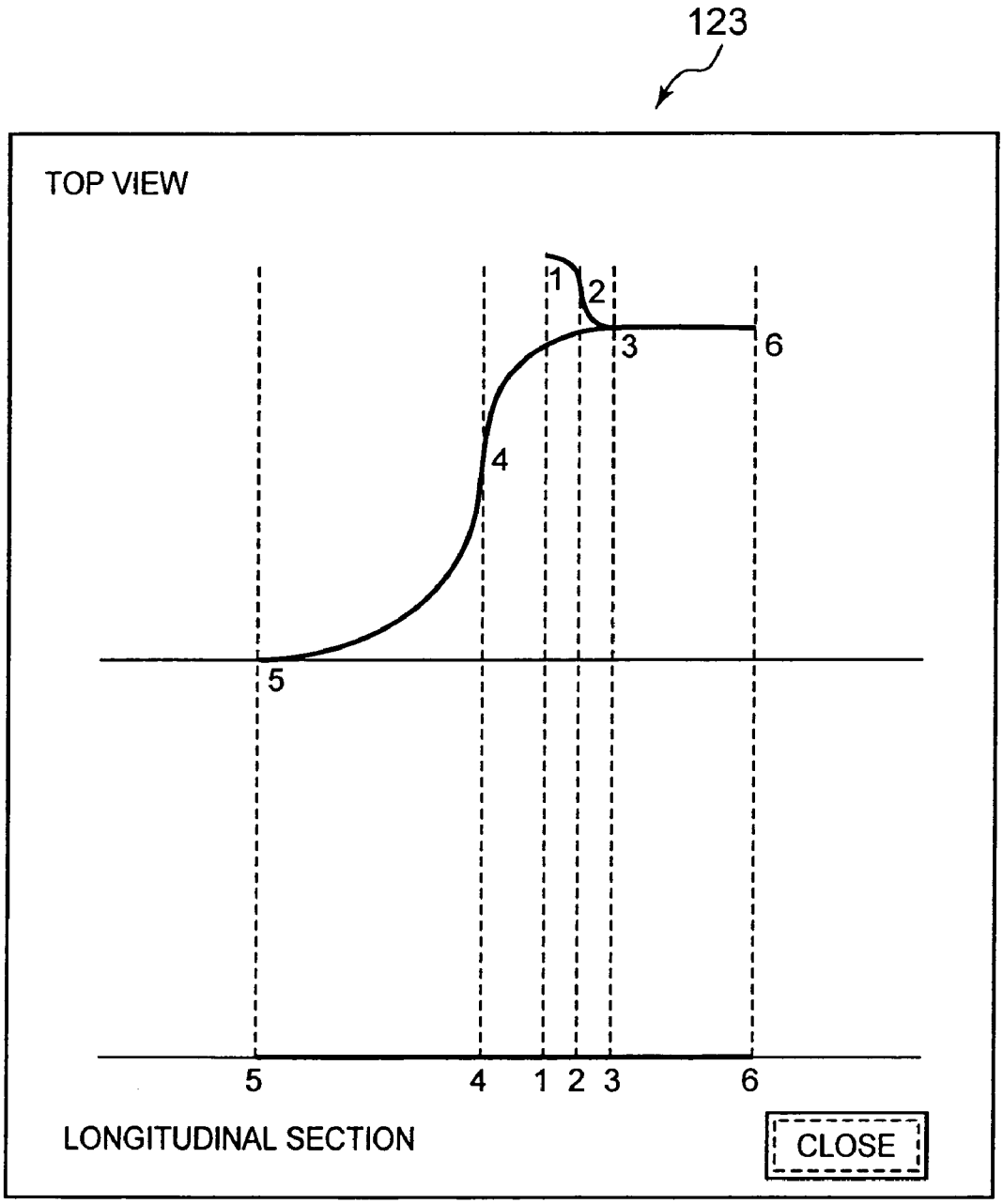
FIG. 4 shows an example of a course.
Figure 5:
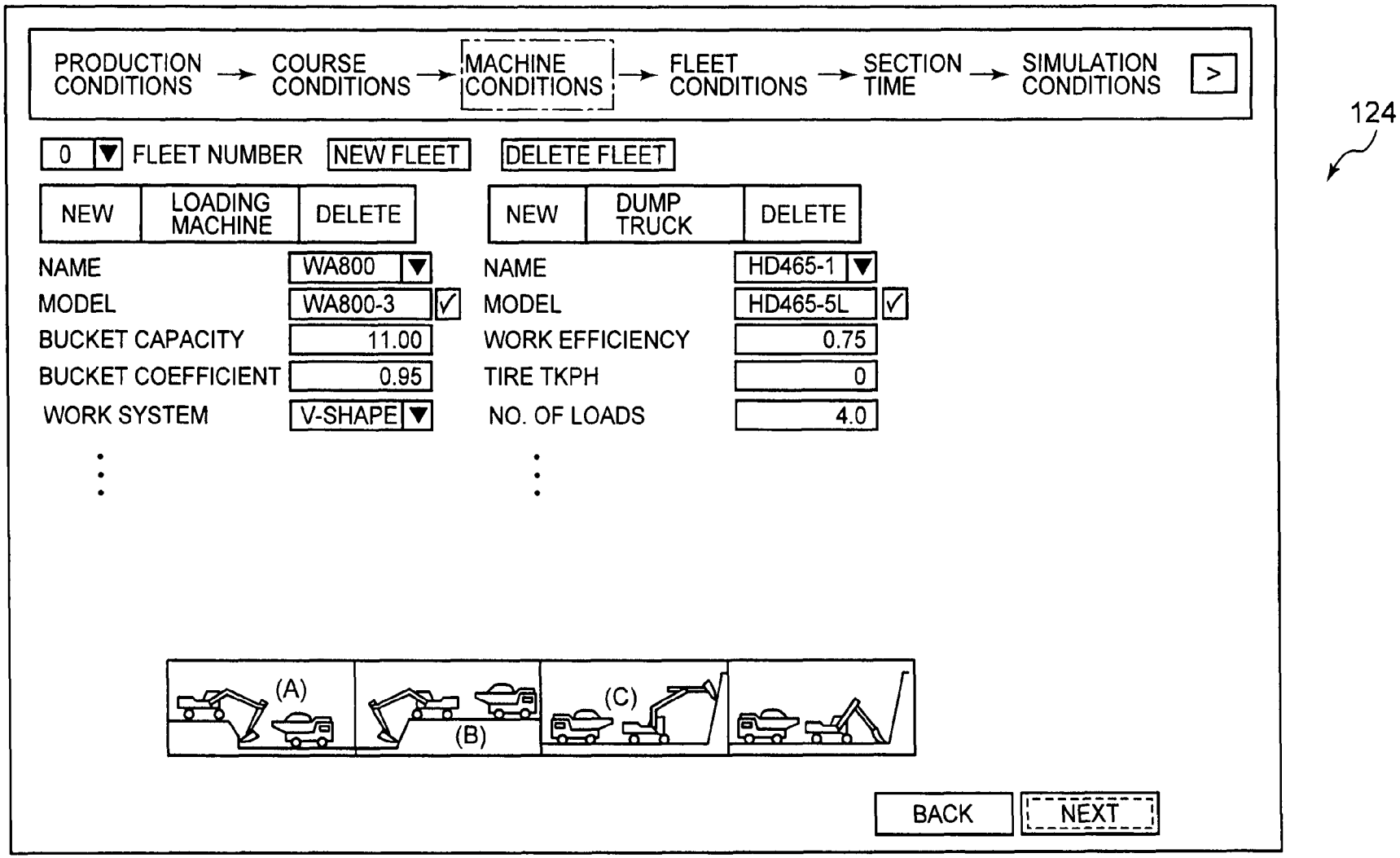
FIG. 5 shows an input screen for machine conditions.
Figure 6:
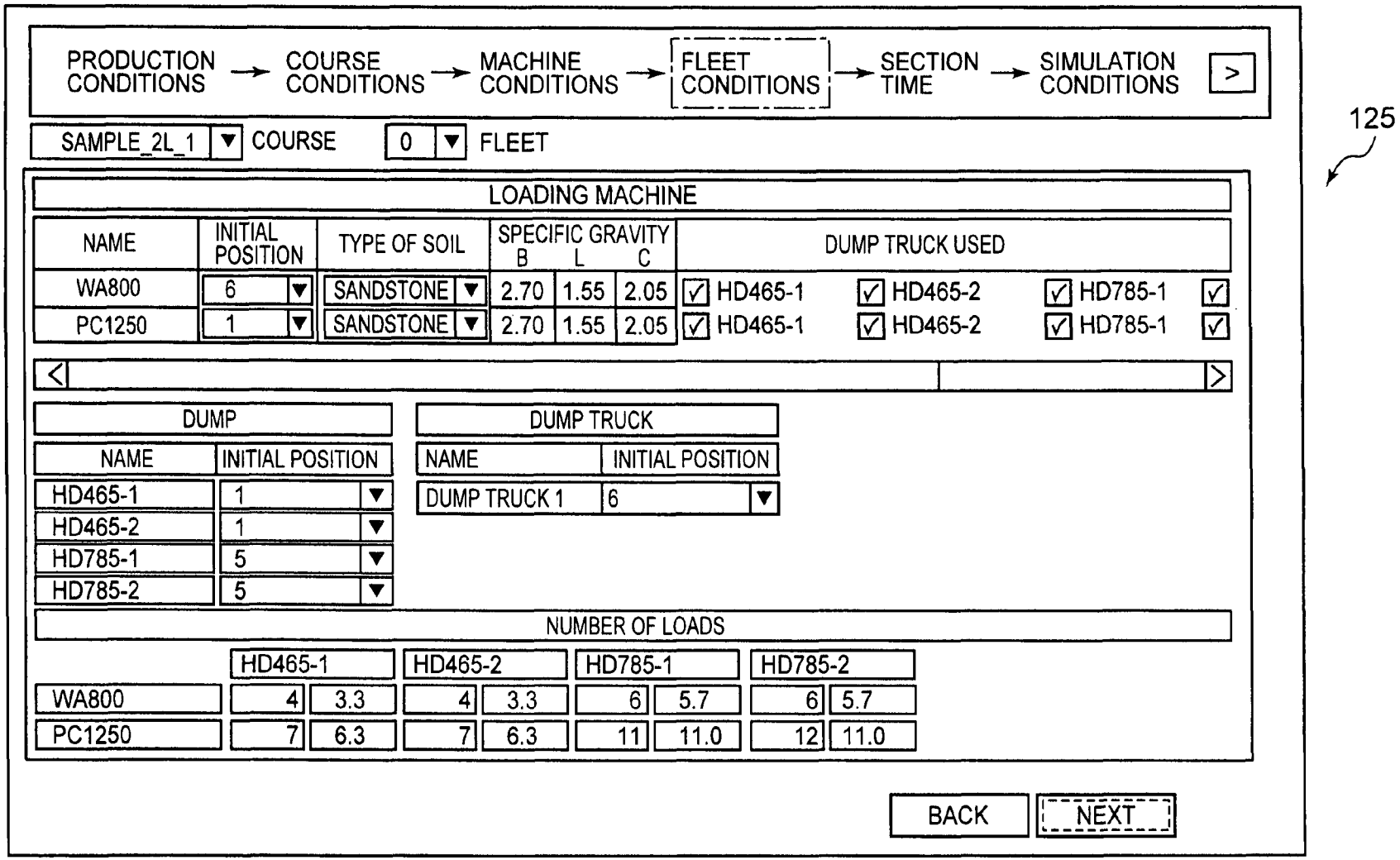
FIG. 6 shows an input screen for fleet conditions.
Figure 8:
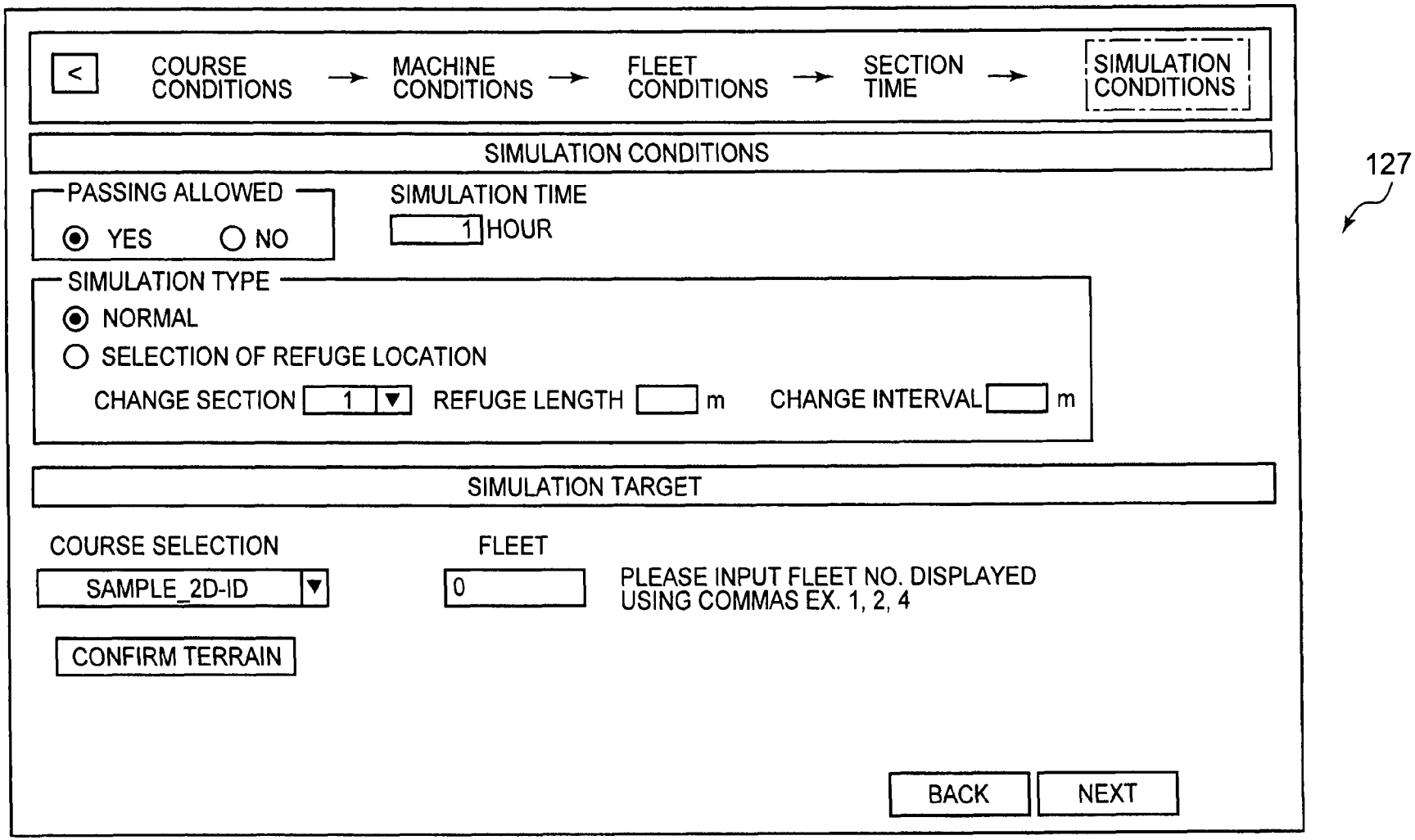
FIG. 8 shows an input screen for simulation conditions.
Figure 9:
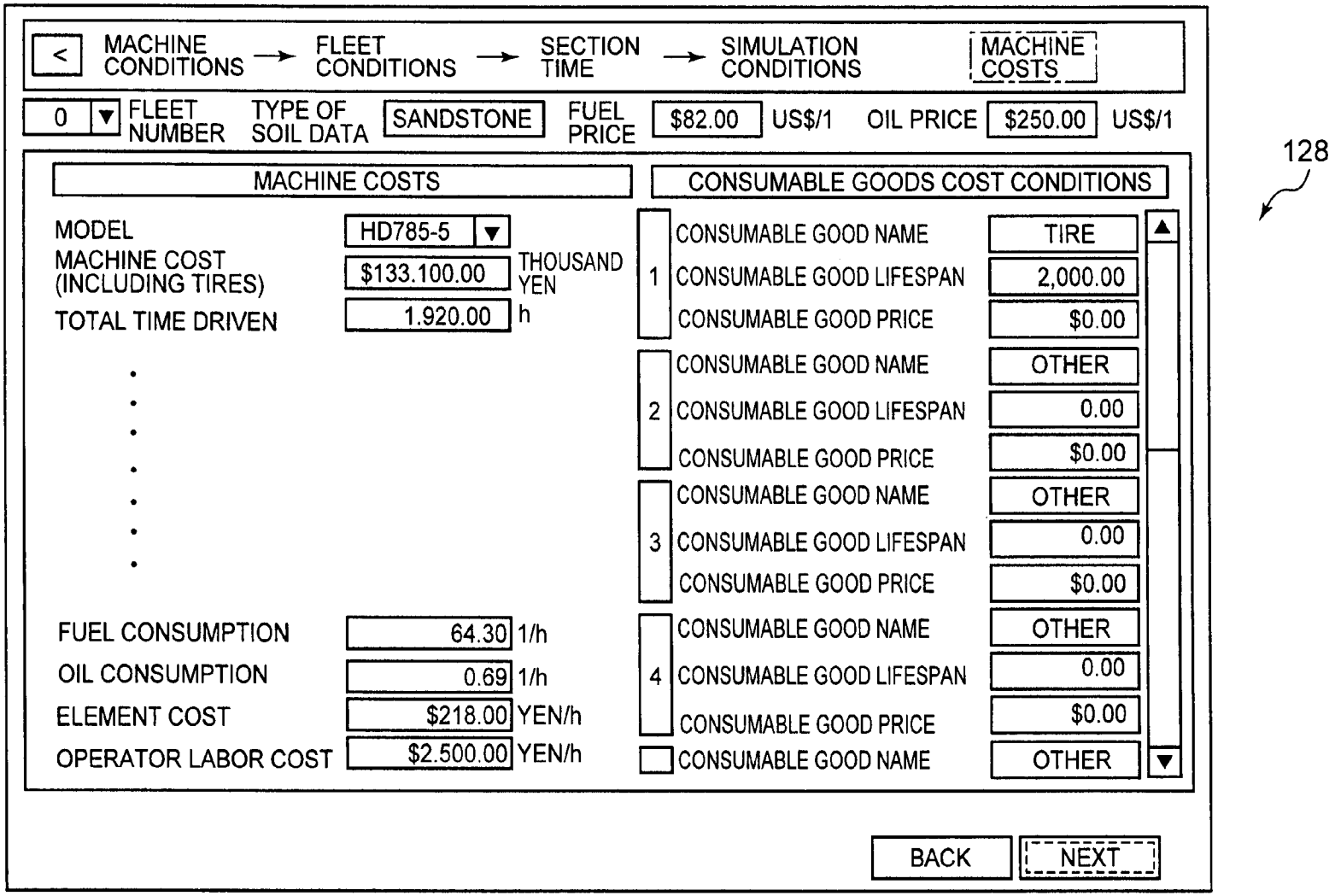
FIG. 9 shows an input screen for machine costs.

A course condition input screen 122 (FIG. 3) is displayed as the next screen. Conditions relating to the type of soil of the mine, the working conditions of the construction machine 3, and the geographical features, for example, are input in the course condition input screen 122. The type of soil of the mine can include the name of the type of soil and the type of soil conversion coefficient and so forth, for example. The working conditions can include the functionality of the dump truck and loading machine and so forth, for example. The geological features can include the site elevation, course width, curve radius, and speed restrictions, for example. Further, the course of the site is automatically created on the basis of the various conditions of the geological features. A course 123 of the site is displayed in a separate window as shown in FIG. 4 by clicking on 'geological feature confirmation' with the mouse on the course condition input screen 122.

A machine condition input screen 124 (FIG. 5) is also displayed. Machine conditions are the fleet number used by the construction machine 3, detailed information on the loading machine (loader, hydraulic shovel) recommended as the construction machine 3, and detailed information on the dump truck, and so forth, for example. The conditions of all the construction machines 3 recommended in order to configure the fleet are input to the machine condition input screen 124. Further, a simulation can be performed by means of a variety of fleet configurations by optionally modifying the number of construction machines input.

In a fleet condition input screen 125 (FIG. 6) which is displayed next, the initial placement positions of the loading machines and dump trucks constituting the fleet, information on whether each of the loading machines is performing loading into any of the dump trucks, and the number of loads per day for each of the loading machines of the dump and so forth are input as the fleet conditions.

In the following section time input screen 126 (FIG. 7), the average speed and section time and so forth of the respective dump trucks are input for each section of the course, for example. As shown in FIG. 7, the average speed and section time and so forth can be input for each section for the outward course and return course.

Further, a simulation condition input screen 127 (FIG. 8) is then displayed. A variety of conditions when the simulation is performed are input in screen 127. For example, in the case of a dump truck, the advisability of passing can be selected. That is, in cases where a plurality of dump trucks are traveling in a row along the same course, or the like, for example, a selection is made to allow passing of a low-speed dump truck by a dump truck capable of higher-speed travel or to implement travel in which passing is not allowed and the row state is maintained.

A machine cost input screen 128 (FIG. 9) is displayed as the next screen. In screen 128, the price of the machine for each recommended construction machine 3 and the costs of consumable goods in addition to machine costs such as the operator labor cost are input, for example.

When a simulation is executed after the above inputs have been made, the normal simulation results are displayed. Individual machine costs, fleet machine costs are displayed divided on the summary screen as the simulation results.

Figure 10:
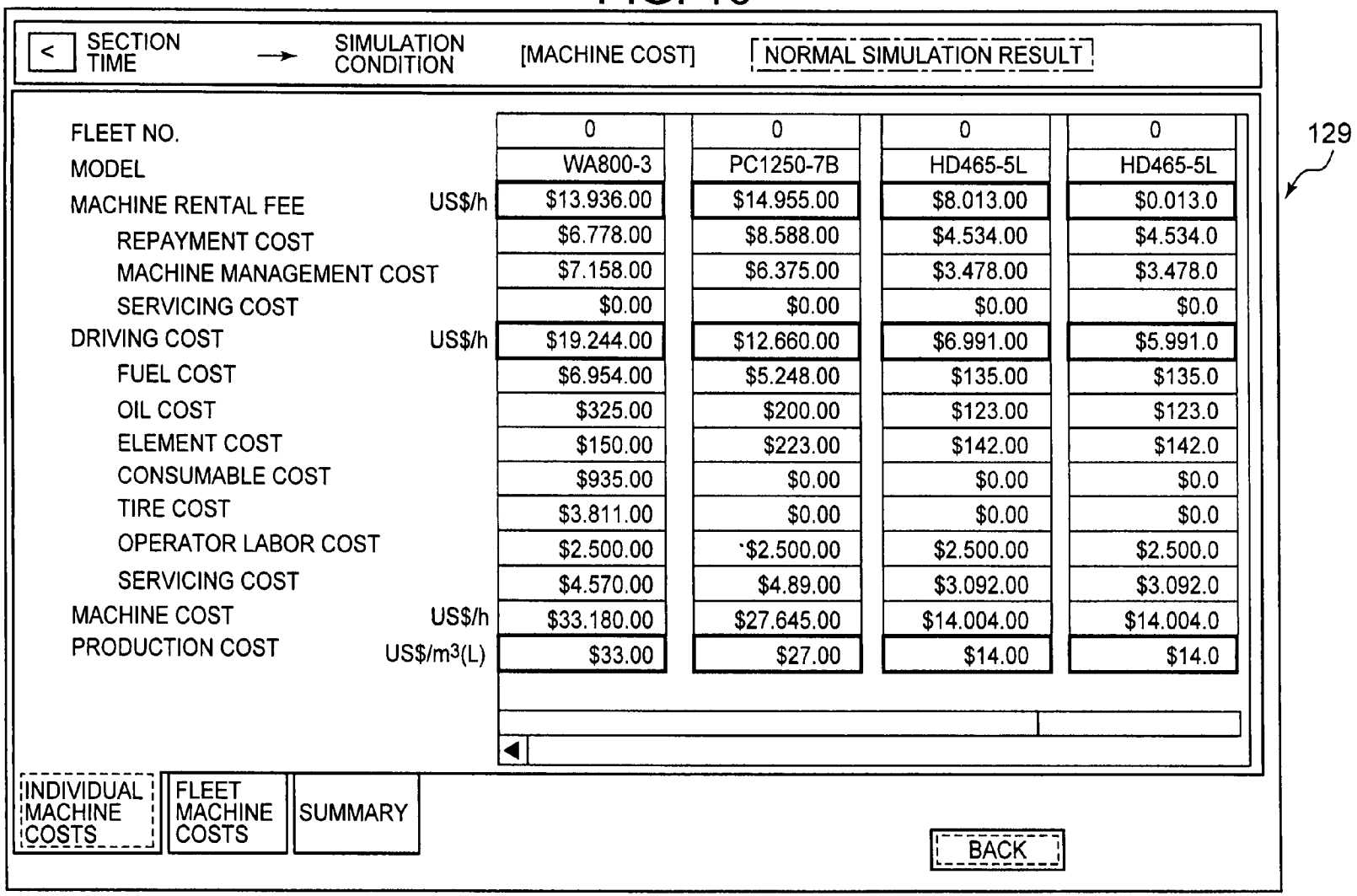
FIG. 10 shows a display screen for individual machine costs of normal simulation results.
Figure 11:
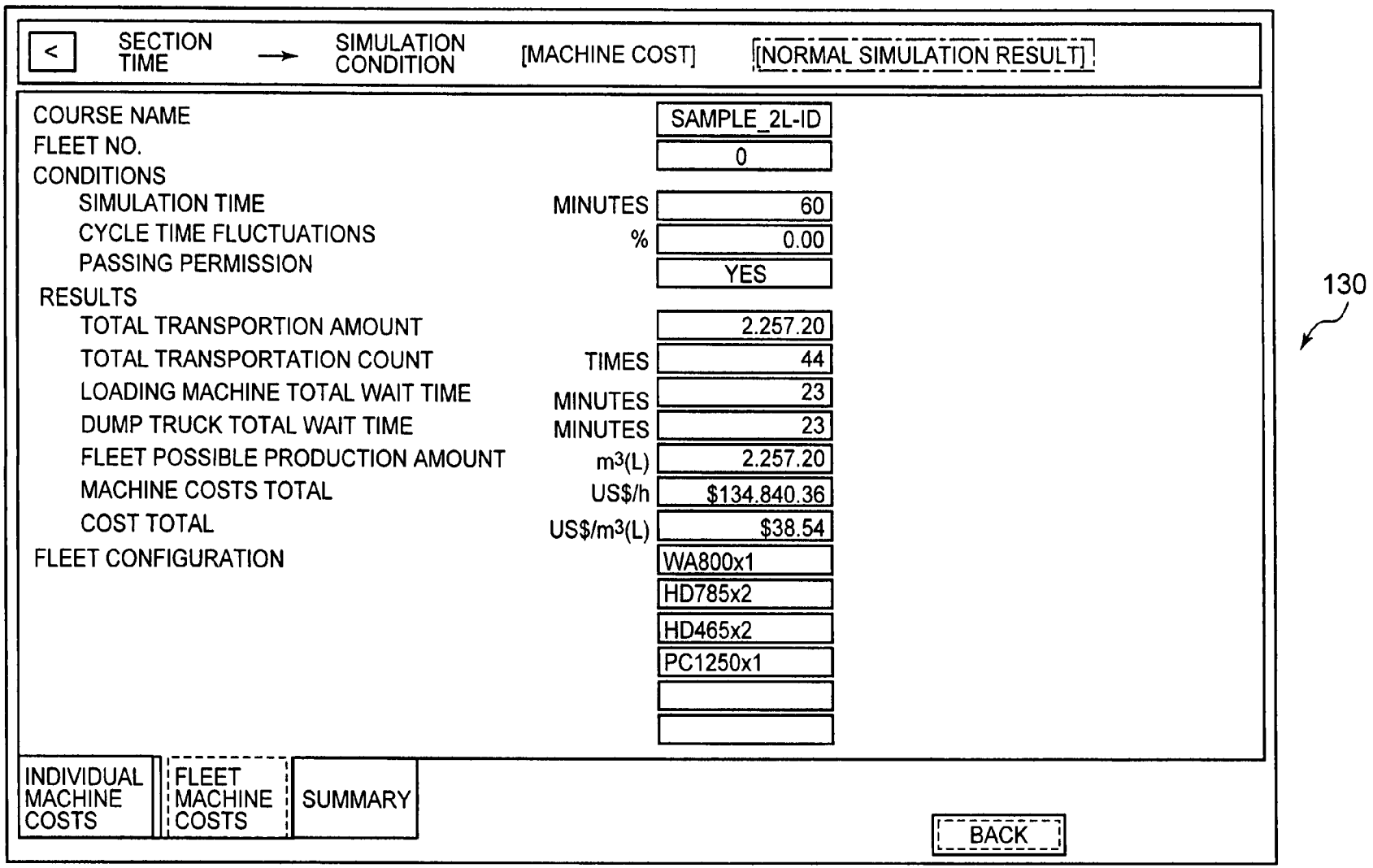
FIG. 11 shows a display screen for fleet machine costs of normal simulation results.
Figure 12:
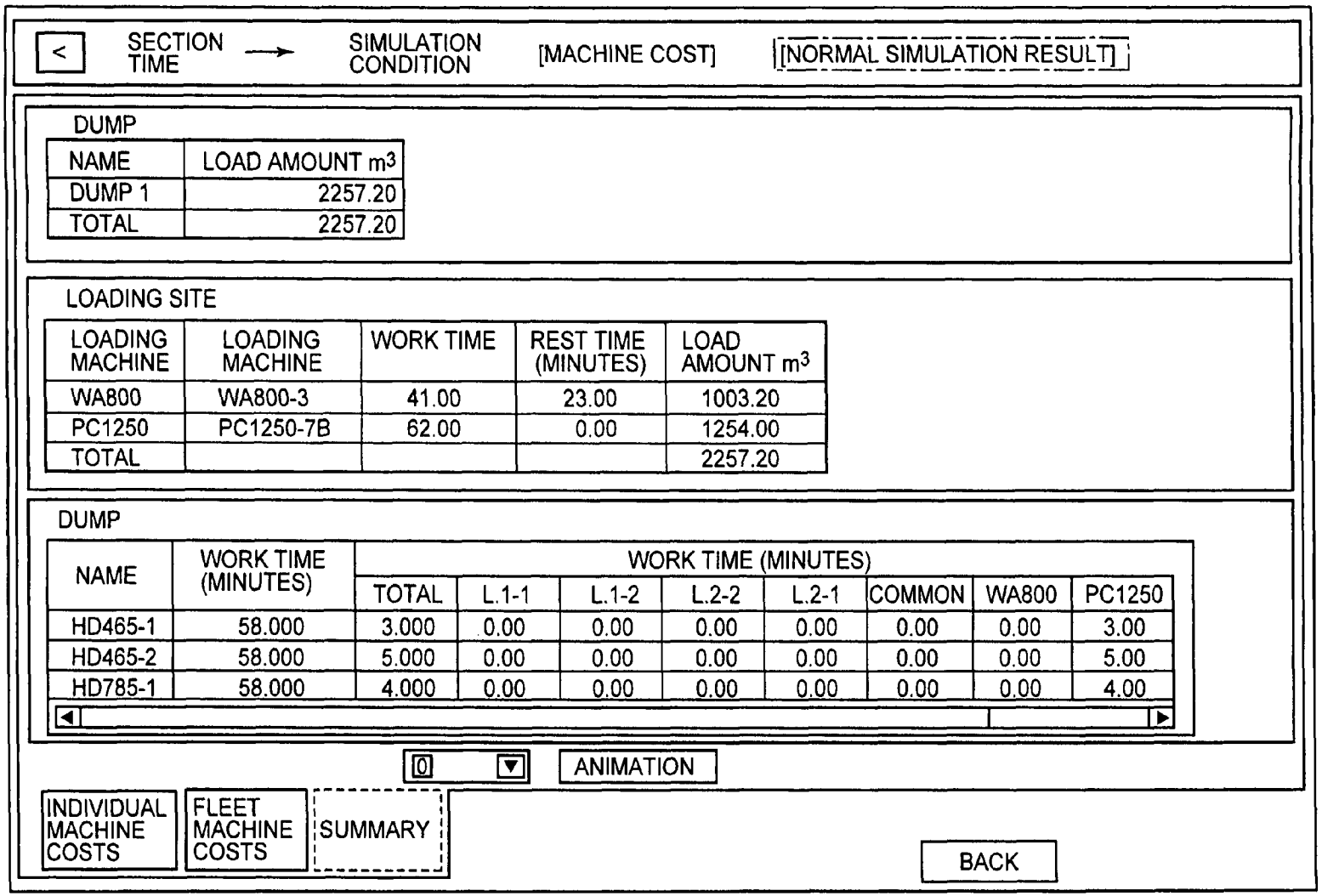
FIG. 12 shows a display screen that summarizes the normal simulation results.

The machine rental fee, driving costs, machine costs, and production costs and so forth for each construction machine 3 constituting the fleet are displayed on the individual machine cost display screen 129 shown in FIG. 10. The machine costs per unit time of the whole fleet, the production costs per unit cubic meter, the total transportation amount per day, and the total wait time and so forth are displayed on the fleet machine cost display screen 130 shown in FIG. 11. The dump amount at the earth removal site, the individual work times and rest times of each of the loading machines and dump trucks, and so forth are displayed on the summary screen 131 shown in FIG. 12.

Figure 13:
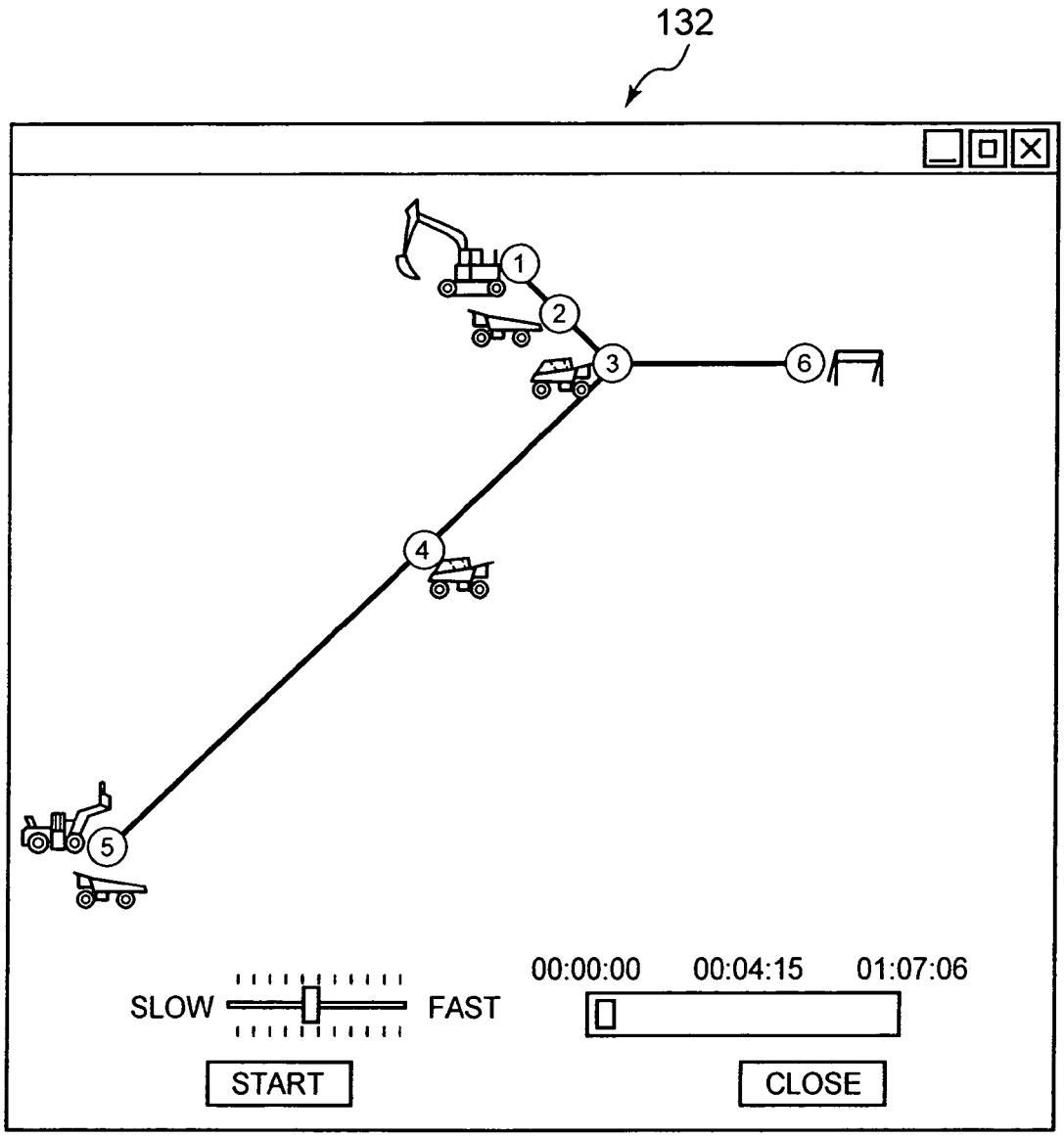
FIG. 13 shows an animation playback screen.

Further, animations showing dump trucks traveling a course on a site in performing a given activity can be displayed as a video display on the basis of the simulation results. Such an animation playback screen 132 is shown in FIG. 13. In this embodiment, the activity of a dump approximately every hour can be displayed at an optional playback speed.

By performing the above operation simulation, the simulation results are presented to the customer together with animations, and sales negotiations for the construction machines 3 are prompted. In addition, the simulation results are used in order to forecast the severity and lifespan of components and are ultimately used as a tool for obtaining information when a maintenance contract is established with a customer. The flow from simulation to maintenance contract will be described hereinbelow also with reference to the flowchart in FIG. 14.

Flow from Simulation Prior to Mine Development to Maintenance Contract

Figure 14:
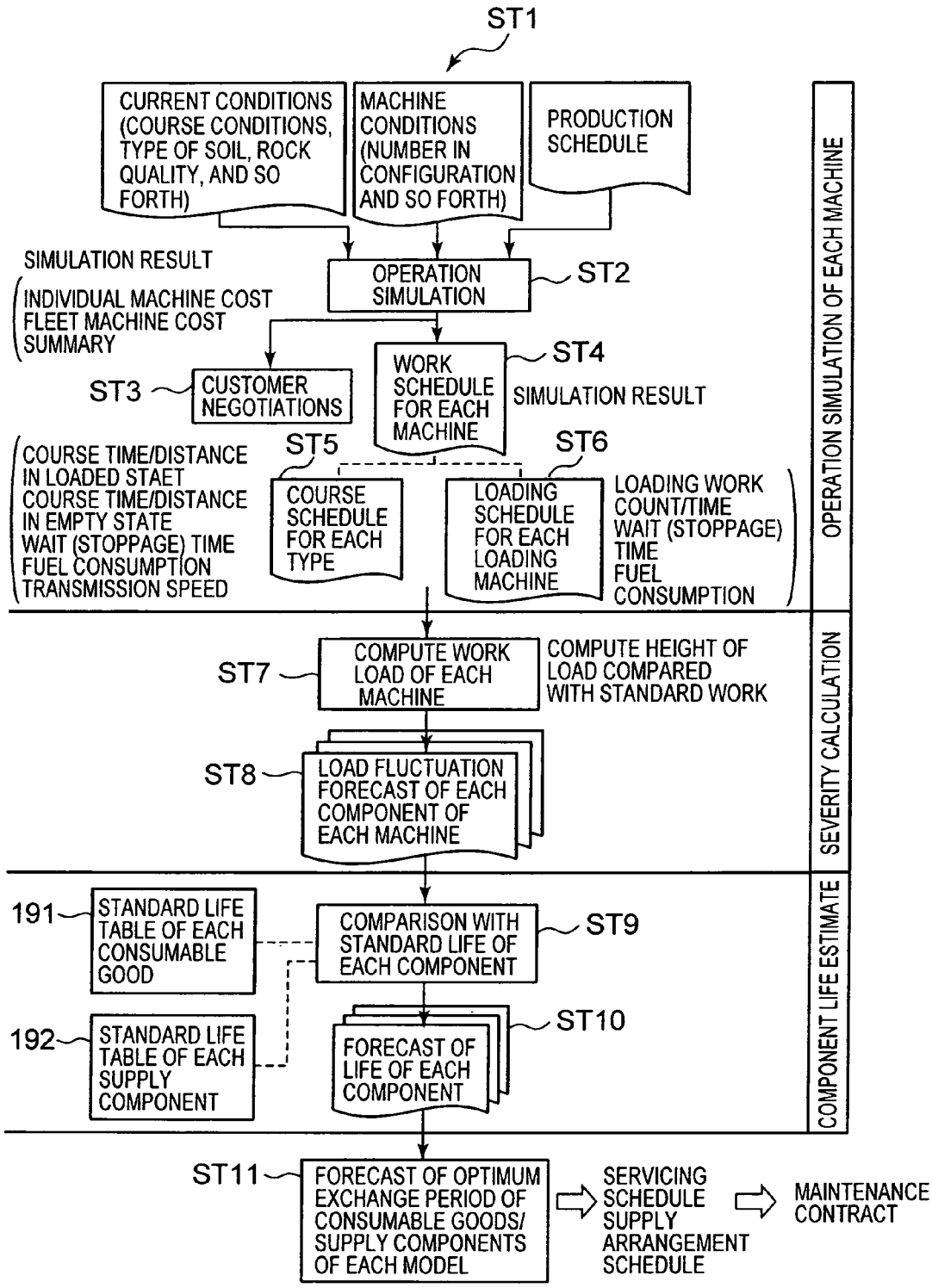
FIG. 14 is a flowchart showing the flow from simulation to maintenance contract.

In FIG. 14, an operation simulation is first performed by the operation simulation means 12 of the computer terminal 10 as mentioned earlier. That is, the site conditions such as the travel conditions and simulation conditions, machine conditions, and the production schedule represented by the production conditions are each input (ST1) in order to execute an operation simulation (ST2).

Negotiations with the customer are then performed by means of individual machine costs, fleet machine costs, and summary information obtained from the simulation results (ST3). Meanwhile, the work schedules of the respective machines 3, that is, the travel schedule of each dump truck and the loading schedules of the respective loading machines (loaders and hydraulic shovels) from the simulation results are also output (ST4 to ST6).

More specifically, the travel schedules of the dump trucks are determined by means of information such as the travel time and distance in a loaded state, the travel time and distance in an empty state, the wait time, the amount of fuel consumed, and the transmission speed and so forth among the production operating conditions, for example. The loading schedule of a loading machine is likewise determined by means of information such as the load work number and time, the wait time, and the amount of fuel consumed and so forth among the production operating conditions. The respective schedules are accumulated in the simulation results database 18 shown in FIG. 1 and can be output by a printer 33 that is connected to terminal 10 if necessary.

Thereafter, the work load, that is, the severity is calculated by starting up the cumulative load calculation means 13 on the basis of the travel schedule and loading schedule (ST7) and the severity is output in order to forecast the load fluctuations of the respective components (ST8).

Here, a calculation table 133 for calculating the severity of the axle frame which is the power line of the loader (see FIG. 16) is shown as an example in FIG. 15. The cumulative load calculation means 13 finds, by means of a predetermined arithmetic expression, a coefficient relating to 'the load size a', a coefficient relating to the 'bias weight b', a coefficient relating to the 'load frequency c', and a coefficient relating to the 'vehicle weight d' from the respective information used to determine the loading schedule, and calculates the severity by multiplying these coefficients.

The coefficient relating to 'the load size a' is divided into five stages between a light load and a heavy load depending on the nature of the work, for example, as a standard, and the coefficient when the loading schedule is executed is computed by the cumulative load calculation means 13. FIG. 15 shows that '1.025' is computed as the coefficient on the basis of the loading schedule for the simulation results of a customer A.

The coefficient relating to 'bias weight b' is divided into three stages in accordance with the size of the target performing the loading, for example. FIG. 15 shows that targets handled by customer A range between medium stones and large stones and that '1.025' has been computed as the coefficient relating to 'bias weight b'.

The coefficient relating to 'load frequency c' is divided into four stages in accordance with the cycle time and fuel consumption, for example. '1.0' is computed as the coefficient in the case of customer A where the cycle time of the loading into a dump truck is between 25 and 40.5 seconds.

The coefficient relating to the 'vehicle weight d' is the vehicle weight in a loaded state and is divided into three stages, for example. For the loader of customer A shown in FIG. 15, packet remodeling resulting in a weight increase, the installation of an ADD weight, and the installation of a change of tire and so forth are performed with respect to a standard vehicle, and '1.05' is calculated as the coefficient.

Therefore, the cumulative load calculation means 13 calculates the severity of the axle frame as '1.103' by means of 'a×b×c×d' from the respective coefficients above. Further, the calculation table 133 is stored in the component standard lifespan database 19.

Returning now to FIG. 14, when the computation of the severity by the cumulative load calculation means 13 ends, the lifespan calculation means 14 starts up and computes the lifespan ratio corresponding with the severity on the basis of the predetermined arithmetic expression. In the case of customer A, when the severity is '1.103', the lifespan ratio is calculated as being '90%' (see FIG. 15). This means that a 10% lifespan is short in comparison with a standard lifespan.

The lifespan calculation means 14 then performs a comparison with the standard life of each component on the basis of the lifespan ratio (ST9). Standard life tables 191 and 192 used at this time are also stored in the component standard lifespan database 19. As a result, the specific lifespan of the axle frame, given a 90% lifespan ratio, is calculated by the number of days or the like. Further, the lifespan thus calculated is output for each component (ST10).

Thereafter, the optimum exchange periods of the consumable goods and supply components and so forth are forecast by referencing the number of days of the lifespan thus calculated (ST11), a maintenance schedule such as a servicing schedule and a supply arrangement schedule is drafted on the basis of the forecast results, and a maintenance contract is established on the basis of the maintenance schedule. The maintenance schedule is based on the lifespan calculated as above and, therefore, the accuracy is higher than that of a maintenance schedule that is drafted simply on the basis of the operating time.

Following the tying up of the agreement, the maintenance contract is fulfilled on the basis of the maintenance schedule. However, in this embodiment, step-by-step operation information can be acquired from the construction machine 3. Hence, following the start of mine development, the actual severity of a component is predictively calculated on the basis of the operation information to find a more truthful lifespan and, if necessary, the maintenance schedule is reviewed and maintenance tasks can be performed in accordance with the latest maintenance schedule. By reviewing the maintenance schedule on the basis of the operation information, a small displacement occurs with respect to maintenance schedule of the simulation and the accuracy of the maintenance schedule improves, whereby it is hard for an unexpected anomaly to arise. The flow of the component lifespan calculation following the start of mine development will also be described with reference to FIG. 16.

Flow of Component Lifespan Calculation Following Start of Mine Development.

As shown in FIG. 16, the operation information on the respective construction machines 3 is accumulated in the step-by-step operating results database 21 for each predetermined time (ST21). As mentioned earlier, the operation information is often converted to map format. Maps formed by combining a plurality of operation information items include the following.

That is, maps include a loading capacity frequency map, a cycle time frequency map, a movement distance frequency map, an excavation time frequency map, an engine load map, a transmission coupling count frequency map, a pre-gear change vehicle speed frequency map, a gear change frequency/R/F speed count map, a load & carry torque/engine speed map, an input torque/slippage ratio map, and an M/C clutch thermal load map and so forth.

Figure 17:
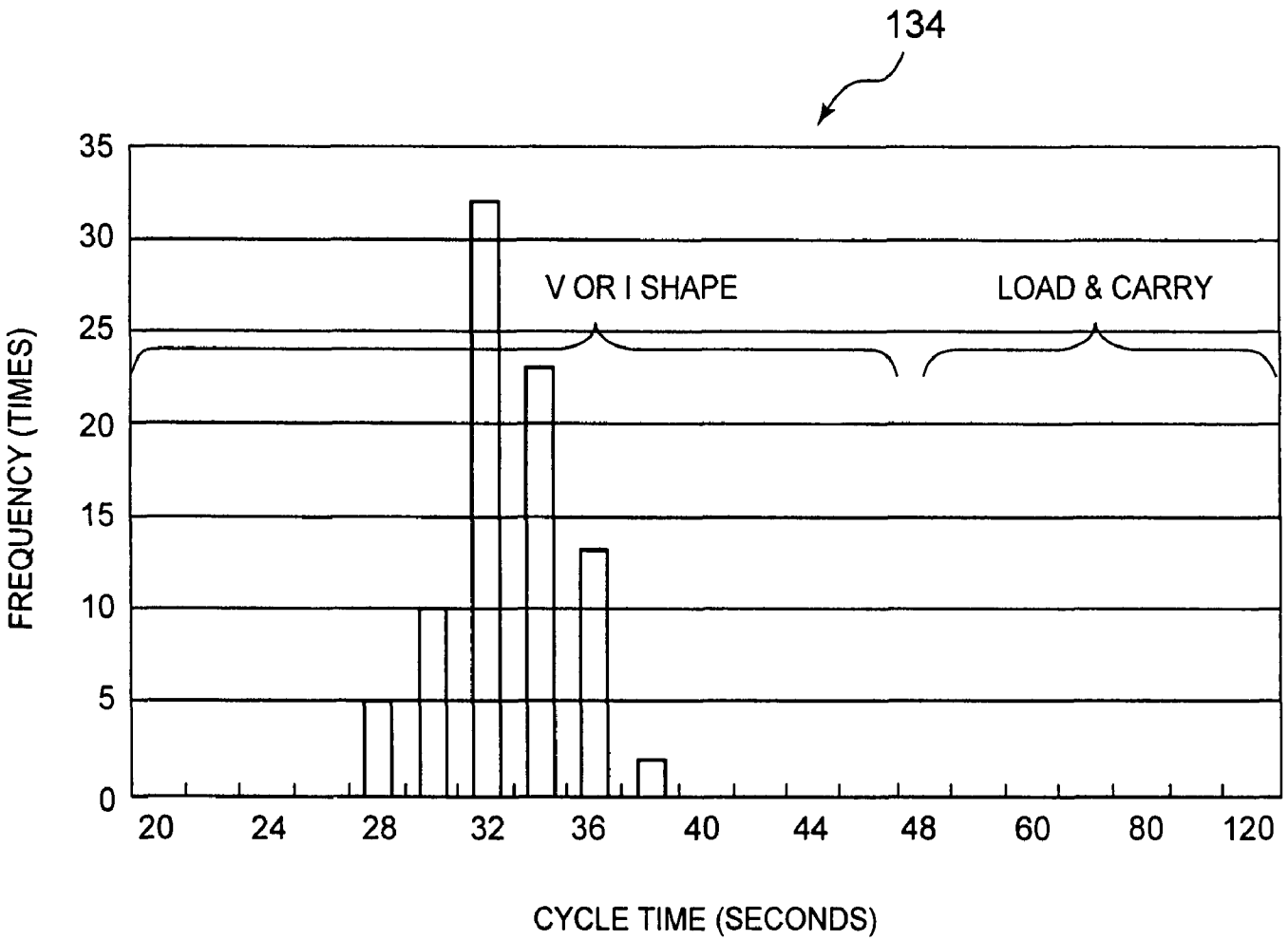
FIG. 17 shows a cycle time frequency map.

Of these maps, the maps required to compute the severity of the axle frame of a loader, for example, are the cycle time frequency map, the movement distance frequency map, the load capacity frequency map, and the excavation time frequency map. As a reference, the cycle time frequency map 134 in FIG. 17 and the movement distance frequency map 135 in FIG. 18 (only for movement distance L1) are shown.

Returning to FIG. 16, the cumulative load calculation means 13 compute the work load based on the information of the respective maps, that is, the severity (ST22), and outputs the severity thus calculated in order to forecast the load fluctuations of the respective components (ST23). Further, the computation table required in the computation of the severity is the same as that shown in FIG. 15.

When the computation of the severity by the cumulative load calculation means 13 ends, the lifespan calculation means 14 starts up and computes the lifespan ratio corresponding with the severity on the basis of a predetermined arithmetic expression, as per the processing during a simulation. Further, the lifespan calculation means 14 performs a comparison with the standard life of each of the components on the basis of the lifespan ratio (ST24). As a result, the specific lifespan based on the actual operating conditions of the axle frame is calculated by the number of days and so forth. Further, the lifespan thus calculated is output to each of the components (ST25).

Thereafter, the optimum exchange periods for the consumer goods and supply components and so forth are forecast by referencing the number of lifespan days thus calculated (ST16) and, when the forecast differs from the forecast during the simulation, maintenance schedules such as servicing schedules and supply arrangement schedules and so forth can be updated by means correction and the accuracy of the latest schedules can be improved.

As detailed above, after the start of mine development, the severity of each component based on the actual driving conditions and working conditions and so forth of the construction machine 3 are calculated and the lifespans are calculated on the basis of the severity. Hence, if a maintenance schedule is updated to the latest state on the basis of the lifespan, the maintenance labor involved in the arrangement and exchange of components can be performed prior to the occurrence of an anomaly.

Further, a case where the severity calculated in ST23 differs greatly from the severity during the simulation may also be considered. Therefore, in this embodiment, the severity during simulation is input at the stage of ST24 (ST27) and a comparison of the severity in each case is performed by starting up the cumulative load comparison means 15 (ST28).

When, as a result, it is judged that there is a large difference in each severity and this difference has occurred due to the input values of the production operating conditions during simulation, this difference is fed back for revival when the next simulation is performed. As a result, during the next simulation, a more appropriate input value is determined and inputted. On the other hand, when it is judged that the difference in the respective severities caused by the arithmetic expression for severity during simulation, the load calculation algorithm modification means 16 starts up and prompt modification of the coefficients and so forth in the arithmetic expression (ST29). As a result, during the next simulation, the severity is computed by a more accurate arithmetic expression and the reliability of the calculation result for the component lifespan increases.

According to this embodiment, the following results apply.

(1) That is, the component recommendation system 1 is able to calculate the severity of each component according to the driving and working conditions after simulating the driving and working conditions of the construction machine 3 on the basis of the production operating conditions prior to the start of mine development and so forth and predictively calculate the lifespan of each component more accurately on the basis of such a cumulative load. Hence, conventionally, in comparison with a case where a maintenance schedule is established in which any component is maintained on the basis of a simple operating time, a more accurate maintenance schedule can be established by forecasting the component lifespan. Hence, the possibility of an unexpected component anomaly occurring at an earlier stage than the expected lifespan can be reduced. As a result, because a component may be systematically brought into the mine development site on the basis of the initial maintenance schedule, there is no need to use airmail, transit via surface mail is adequate and transportation costs can be considerably reduced.

(2) In addition, because this embodiment allows the accuracy of the component maintenance schedule to be improved, the occurrence of unexpected component exchange can be reduced. Therefore, when a maintenance contract with the customer is fulfilled, the possibility of performing work that departs greatly from the maintenance schedule decreases, whereby the workability of the maintenance work can be improved and maintenance costs can be reduced.

(3) In this embodiment, the severity of each component is predictively calculated for each predetermined interval on the basis of the actual operating information of the construction machine 3 after the start of mine development, whereby the latest lifespan of the respective components can be calculated on the basis of such severity. Hence, the maintenance schedule can be updated to a more accurate maintenance schedule on the basis of the latest lifespan forecast and the timely transportation of the components by surface mail may be performed more reliably.

(4) In this embodiment, when there is, for any reason, a difference between the severity calculated by the simulation before the construction machine 3 is operating and the actual severity, the cumulative load comparison means 15 starts up and judges this difference. Further, because the arithmetic expression for computing the severity during simulation can be changed by the load calculation algorithm modification means 16, the accuracy of the next simulation can be further improved and a suitable maintenance contract can be exchanged by further improving the accuracy of the maintenance schedule.

Second Embodiment

Figure 19:
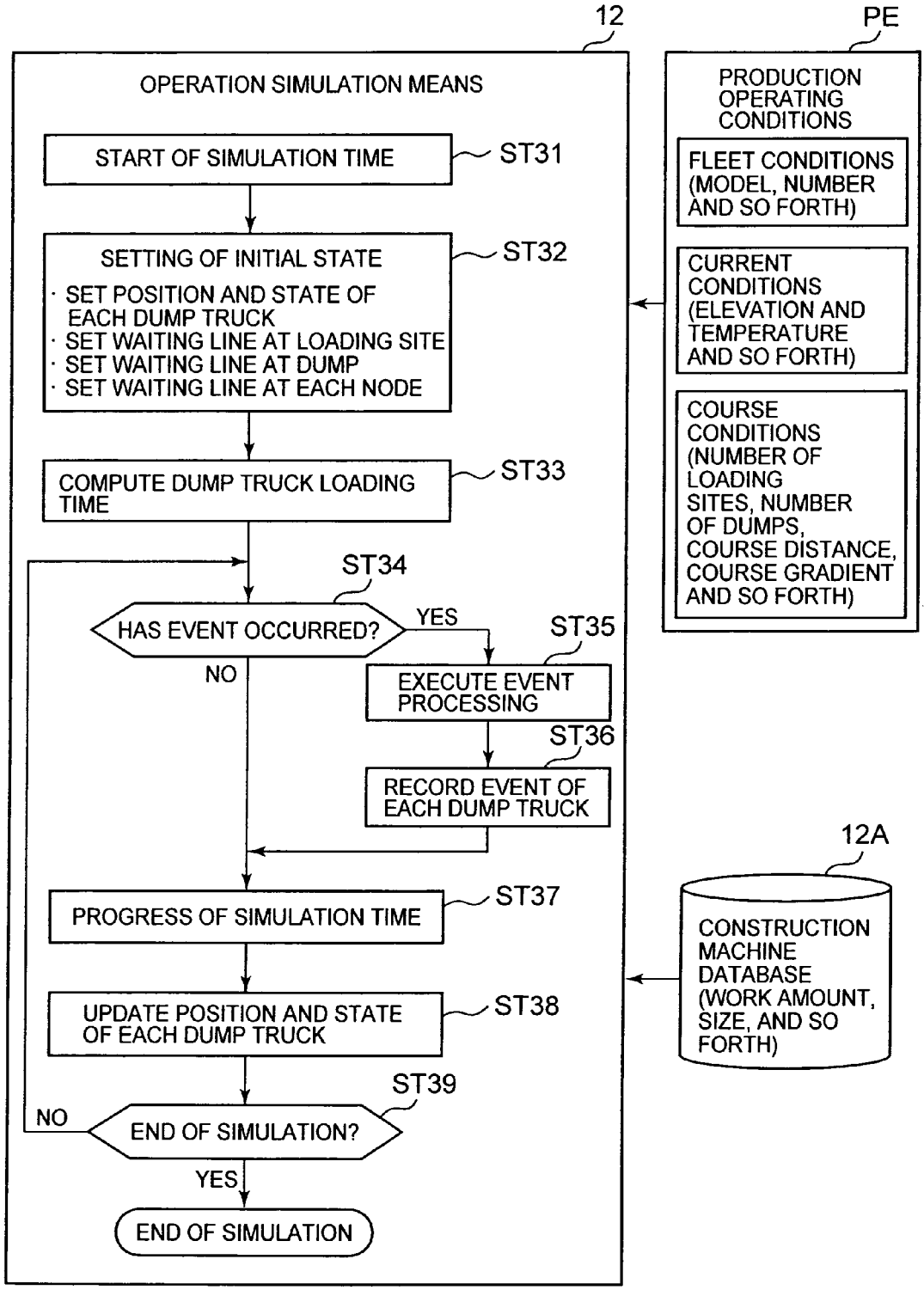
FIG. 19 shows the constitution of operation simulation means.

A more detailed, specific example of the above embodiment will be described hereinbelow. First, FIG. 19 shows a specific constitutional example of the operation simulation means 12. The operation simulation means 12 simulates the behavior of the respective construction machines 3 on the basis of the production operating conditions and the specifications of each of the construction machines 3 as mentioned earlier.

In the following example, a case where a plurality of dump trucks travel to and fro between a loading site and dump, for example, is described. That is, at the loading site, the loader loads earth and sand and ore and so forth into the dump truck. The dump truck in which the sand and earth and so forth are loaded moves to the dump via the course to dump the earth and sand at the dump. The dump truck with an empty load then returns via the course to the loading site and awaits the opportunity to load the sand and earth and so forth.

At the loading site, a wait time until completion of the loading onto the dump truck that arrived first occurs. Likewise, a wait time until completion of dumping by the dump truck that arrived first at the dump arises. In addition, during travel, congestion and so forth caused by traffic regulations is produced and a wait time is produced. The operation simulation means 12 simulates the behavior of the respective construction machines 3 by means of an event-driven system in a virtual production site space modeled as mentioned earlier.

As shown by code PE in FIG. 19, the production operating conditions includes fleet conditions, site conditions, and course conditions. The fleet conditions include, for example, information on the models and numbers of each of the construction machines 3 constituting the fleet, for example. The site conditions include, for example, information on the elevation and temperature and so forth of the production site in which the construction machines 3 are used. The travel conditions include, for example, information such as the number of loading sites established, the number of dumps established, the course distance between the loading sites and dumps, the gradient of the course, the positions of curves, and travel regulations (whether a one-way regulation exists).

Information relating to the specifications of the various construction machines 3 is stored in a construction machine database 12A. Specification information can include, for example, the work amount on each occasion, the transportation capacity, the size, and the speed of movement, and so forth.

The action of the operation simulation means 12 will now be described. First, the operation simulation means 12 initializes the simulation time (ST31). The simulation time can be established as the time taken to achieve the operation time or scheduled production amount for one day, for example. Further, because the simulation time can be varied faster than the actual time, the change in behavior corresponding to one day in the real world can be simulated in a short time.

Thereafter, the operation simulation means 12 establishes an initial state (ST32). Initial state settings can include, for example, setting the initial positions and states of the respective construction machines 3, setting the waiting lines of the respective loading sites, setting the waiting lines at the respective dumps, and setting the wait lines of the respective nodes on the course. Further, the setting of the respective waiting lines can include the time for processing the waiting lines (loading times and dump times and so forth).

As mentioned earlier, a plurality of nodes can be established on the course linking the loading sites and dumps in the simulation space. The nodes can be established at points where the course environment changes such as points where a linear course changes to a curve and points where two-way passage changes to one-way road, for example. Further, nodes can also be established for each predetermined distance such as every mile or every ten kilometers, for example. The nodes can also be established by combining points of change in the distance and course environment.

Thereafter, the operation simulation means 12 starts the loading work for the dump truck that is at the head of the loading site waiting line (ST33). That is, the operation simulation means 12 starts the count of the predetermined loading time for the first dump truck and produces a loading termination event when the count has been made (ST33).

Directly following the start of the simulation, the event does not occur until the load time to the first dump truck has elapsed. When the loading time for the first dump truck has elapsed, the 'loading termination event' for this dump truck occurs. The dump truck that has completed loading moves to the dump while traveling along a predetermined course. A row of dump trucks that are waiting at the loading site is then shortened by one and the loading to the next dump truck is started. Thus, the operation simulation means 12 is able to simulate the behavior of the respective dump trucks in parallel. The behavior of the respective objects (construction machines 3) is advanced on the basis of an event-driven system. That is, the occurrence of a certain event is the trigger for another event that continues on from the event and progresses in sequence.

When the occurrence of the event is detected (ST34:YES), the operation simulation means 12 performs processing that corresponds with the event that has occurred (ST35). The details of the event processing will be further described subsequently. Further, the operation simulation means 12 records the events of the respective dump trucks together with time information in the simulation space in the simulation results database 18 (ST36).

The operation simulation means 12 advances the simulation time (ST37) and updates the positions and states of the respective dump trucks respectively (ST38). The operation simulation means 12 advances the time in the simulation space by a predetermined unit time (10 minutes, for example) and updates the positions and states in the simulation space of the respective dump trucks corresponding with the time advance. States can include, for example, a 'loading wait state', a 'state of outward travel to the dump', a 'travel wait state', a 'dump wait state', a 'state of return travel to the loading site' and so forth.

The operation simulation means 12 judges whether or not to end the simulation (ST39). For example, the simulation is ended in cases where the scheduled time set at the start of the simulation is reached and where the target production volume is reached. Further, the simulation can also be ended when an interruption is ordered by a manual operation.

Directly following the start of simulation, earth and sand and so forth is successively loaded into the dump trucks waiting at the loading site and the loading termination events occur one after another. The dump trucks for which loading is complete start to travel in order and, as a result, other events occur at the respective nodes on the course. The dump trucks then each arrive at the dump, join the dump wait line and then start to move toward the loading site when dumping is complete.

The details of event processing will now be described on the basis of FIGS. 20 and 21. In the event processing, the types of events that have occurred are judged and predetermined processing is performed in accordance with the types of the respective events.

When a loading termination event has occurred (ST41: YES), the operation simulation means 12 advance one by one through the waiting line at the loading site and computation (counting) of the loading time is started for the dump truck located at the head of the wait line (ST42). When the loading time has elapsed, the state of the dump truck moves from the 'loading wait state' to 'loading termination state' and the loading termination event occurs. Further, the loading site waiting line is a line for awaiting the loading of earth and sand and so forth of a predetermined amount by a loading machine. The maximum load capacity of each dump truck differs from model to model.

Thereafter, the operation simulation means 12 performs processing with respect to the dump trucks for which the loading termination event has occurred (ST43). That is, the operation simulation means 12 sets a target dump for dump trucks for which loading has ended and selects the travel route to the dump (ST43). In addition, the operation simulation means 12 calculates the travel pattern to the first node on the travel route, the transmission speed, and the travel time and so forth respectively (ST43). Travel patterns can include the temporal change in the acceleration state, for example.

As mentioned earlier, when a loading termination event has occurred, processing relating to another dump truck that is waiting at the loading site (ST42) and processing to start the next event relating to the dump truck for which the loading termination event occurred (ST43) are executed.

Although the order is approximate, a loading site arrival event will be described next. The loading site arrival event is an event that occurs when the dump truck arrives at a predetermined loading site associated with the dump truck. When a loading site arrival event has occurred (ST44), the operation simulation means 12 adds the dump truck that has arrived at the loading site to the very end of the waiting line of the loading site (ST45).

A dumping termination event will be described next. The dumping termination event is an event that occurs when the dump truck has dumped its load at the dump. When the dumping termination event has occurred (ST46:YES), the operation simulation means 12 processes the waiting line at the dump (ST47) and then performs processing to start the next event pertaining to the dump truck for which the dumping termination event occurred (ST48).

That is, the operation simulation means 12 moves through the waiting line at the dump one at a time and starts measurement of the dumping time for the dump truck at the head of the waiting line (ST47). Thereafter, the operation simulation means 12 selects the loading site to which the dump truck is to return as well as the travel route to the loading site for the dump truck with an empty load that has completed dumping (ST48). The operation simulation means 12 also calculates the travel pattern as far as the first node on the travel route, the transmission speed, and the travel time and so forth (ST48).

A dump arrival event will be described next. A dump arrival event is an event that occurs when the dump truck reaches the dump associated with the dump truck. When the dump arrival event occurs (ST49:YES), the operation simulation means 12 adds the dump truck that has arrived at the dump to the very end of the dump waiting line (ST50).

When processing for each of the above events is performed, the event processing ends and returns to the main flowchart of the operation simulation processing shown in FIG. 19.

Figure 20:
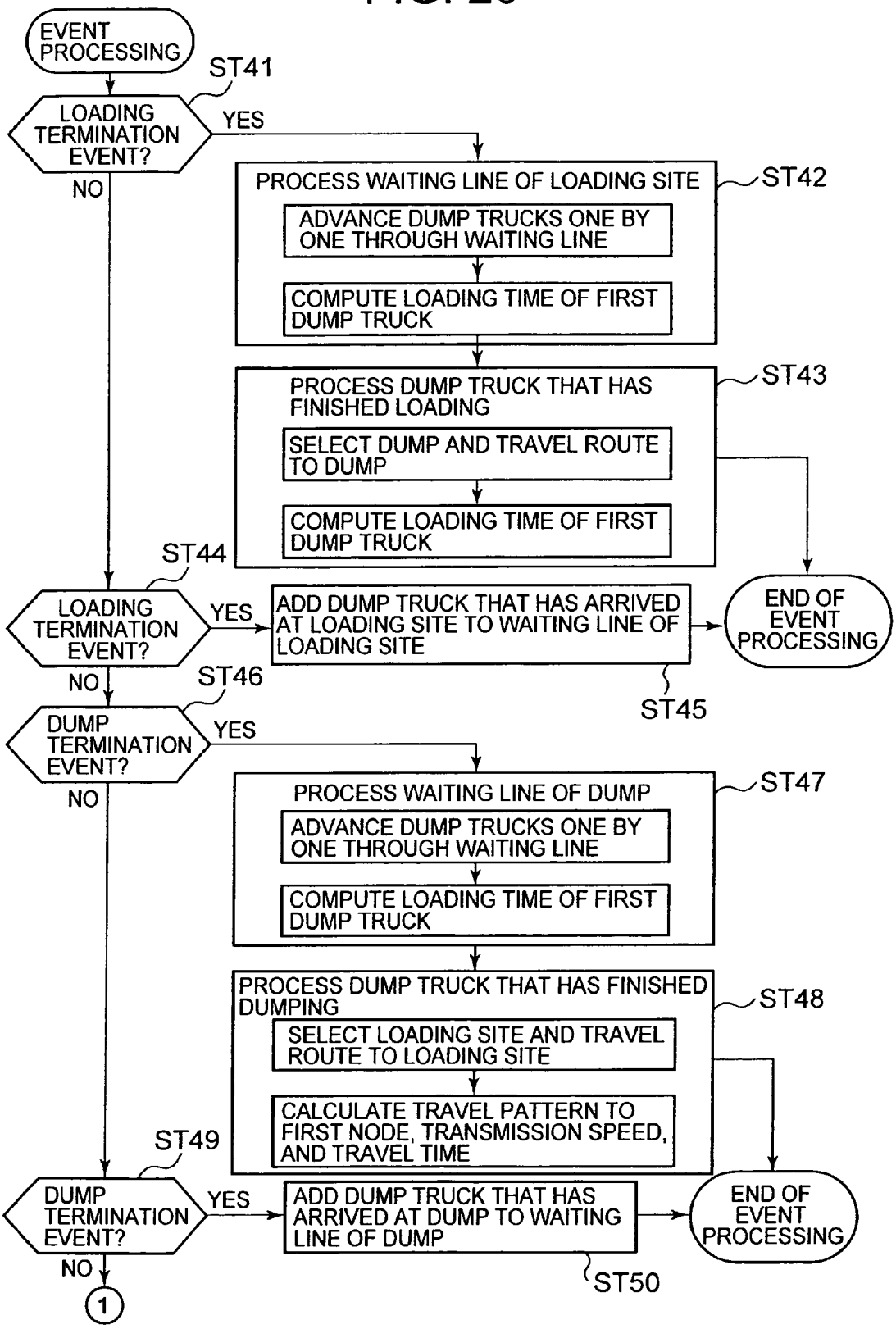
FIG. 20 is a flowchart showing the details of event processing.
Figure 21:
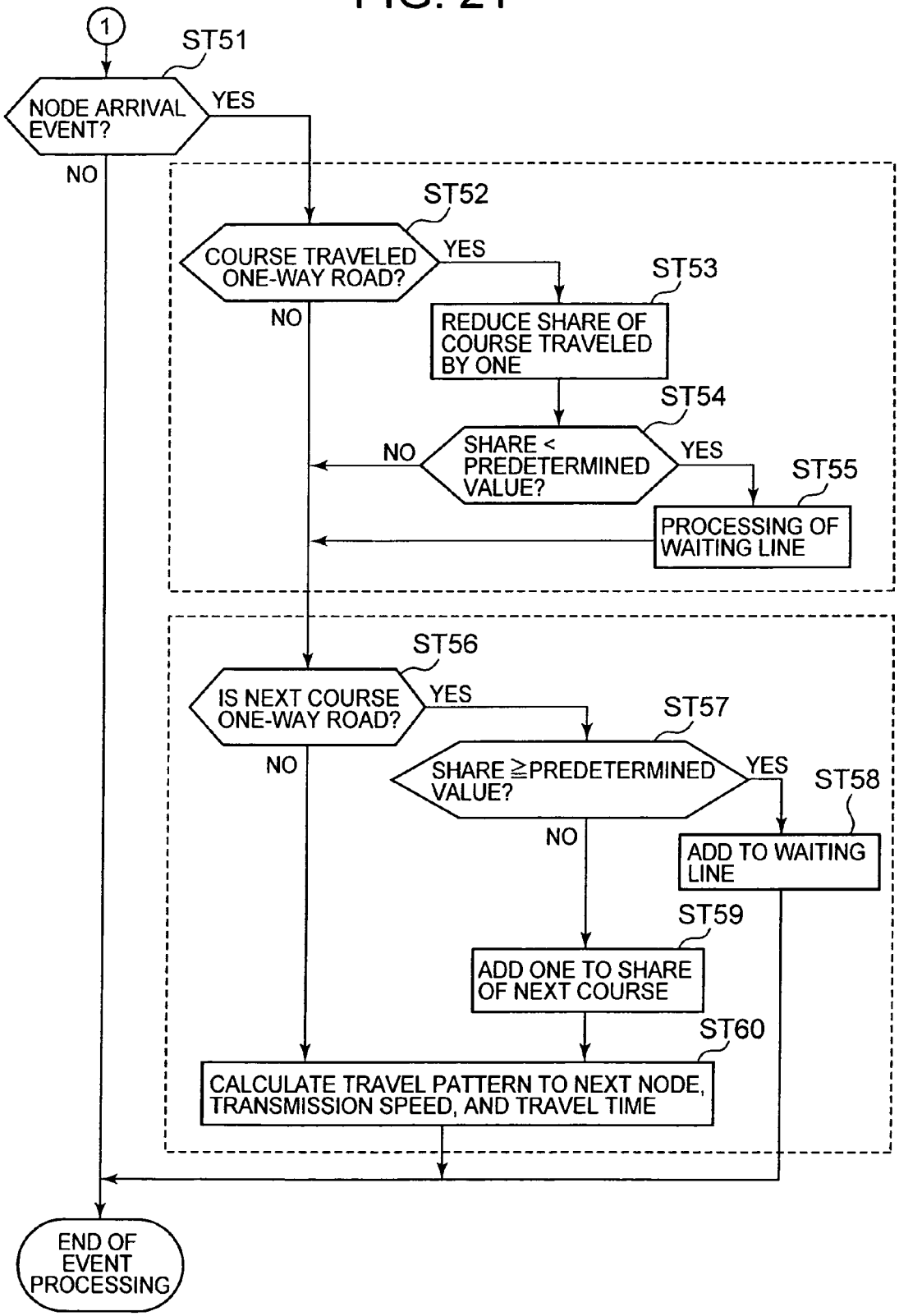
FIG. 21 is a flowchart of event processing that continues on from FIG. 20.

FIG. 21 is a flowchart of the event processing that follows FIG. 20. A node arrival event is an event that occurs when a dump truck arrives at a node on a travel route that has been established for a dump truck. Each dump truck is provided with one travel route for the outward trip and one for the return trip. At least one or more nodes are established for the respective travel routes of the outward trip and return trip.

When the node arrival event occurs (S51:YES), the operation simulation means 12 executes processing related to a course along which the dump truck passes (ST52 to ST55) and processing related to the course that is traveled next (ST56 to ST60) respectively.

First, it is judged whether the course along which the dump truck passes immediately prior to arriving at the node is a one-way road (ST52). When the dump truck arrives at the node by traveling along a one-way road (ST52:YES), the operation simulation means 12 reduces, by one, the share of the one way road that the dump truck has passed along (ST53). The share is information indicating the congestion of the course (amount of travel). This means that, the higher the share of the course, the greater the number of dump trucks are traveling and there is congestion.

The operation simulation means 12 compares the share of the one-way road with a predetermined value that has been preset and judges whether the share is less than the predetermined value (ST54). When the share is less than the predetermined value (ST54:YES), because the next dump truck can be made to enter the one-way road, the operation simulation means 12 moves the dump trucks one by one through the waiting line at the start of the one-way road (ST55). That is, of the dump trucks waiting one node before the node pertaining to the node arrival event, the dump truck at the head of the waiting line is made to enter the one-way road.

On the other hand, when the path along which the dump truck has traveled just before arriving at the node arrival event is not a one-way road (ST52:NO) or when the share of the one-way road the dump truck passed along is equal to or more than a predetermined value (ST54:NO), the operation simulation means 12 moves to step ST56.

The operation simulation means 12 judges whether the course along which the dump truck for which the node arrival event occurred will travel next is a one-way road (ST56). When the course to be traveled along is a one-way road (ST56:YES), the operation simulation means 12 compares the share of the course for which passage is planned with a predetermined value that has been preset and judges whether the share is equal to or more than the predetermined value (ST57). The predetermined value can be established as a different value from the predetermined value mentioned in ST54. The predetermined value is a threshold value for judging whether it is possible to enter the next course.

When the share of the next course is equal to or more than the predetermined value (ST57:YES), the operation simulation means 12 adds the dump truck to the very end of the waiting line (ST58). That is, the dump truck for which the node arrival event occurred is added to the very end of the row of dump trucks waiting for permission to enter the next course.

On the other hand, when the share of the next course is not equal to or more than the predetermined value (ST57:NO), the operation simulation means 12 adds one to the share of the next course (ST59). The operation simulation means 12 adds one to the share associated with the next course in order to allow the dump truck for which the node arrival event occurred to enter the next course.

The operation simulation means 12 then calculates the travel pattern from the current node to the next node, the transmission speed, the travel time and so forth respectively (ST60). Further, when the course that is to be traveled next is not a one-way road (ST56:NO), because there is no requirement to perform waiting line processing, the operation simulation means 12 moves to ST60.

Event processing was described hereinabove. As mentioned earlier, in the simulation model used by the operation simulation means 12, the respective events probably occur a plurality of times for each dump truck in the order of the loading termination event, followed by one or a plurality of node arrival events (outward trip), the dump truck arrival event, the dumping termination event, one or a plurality of node arrival events (return trip), the loading site arrival event, and then the loading termination event.

Further, when the focus is on the states of the respective dump trucks, the state transitions are the loading wait state, followed by the loading state, the loading termination state, the traveling state, the dumping wait state, the dumping state, the dumping termination state, the traveling state, and then the loading wait state and so forth.

Figure 22:
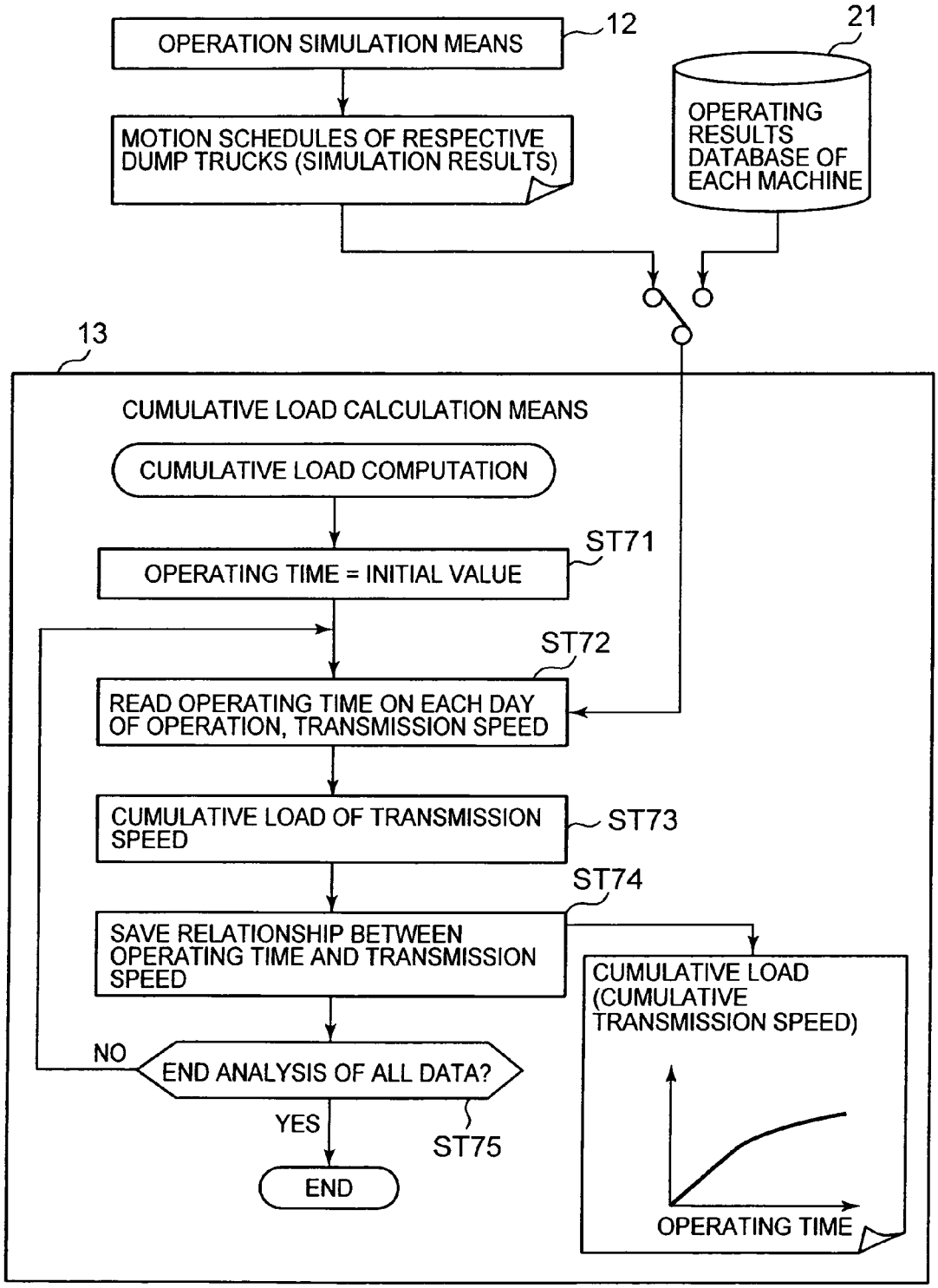
FIG. 22 shows the constitution of the cumulative load calculation means.

FIG. 22 is an explanatory diagram of a constitutional example of the cumulative load calculation means 13. As mentioned earlier, the cumulative load calculation means 13 is capable of calculating the cumulative loads of the respective components on the basis of both the simulation results by the operation simulation means 12 or the operating information that has accumulated in the operating results database 21. For the sake of expediency in the description, in the following description, the value calculated on the basis of the simulation results is sometimes known as the 'forecast cumulative load' and the value calculated on the basis of the operation information is sometimes called the 'actual cumulative load'. Further, in the following description, the transmission of the dump truck will be described by way of example of a predetermined component that is a maintenance target.

The cumulative load calculation means 13 sets an initial value for the operating time when calculating the cumulative load (ST71). The cumulative load calculation means 13 then reads the operating time or transmission speed for each day of operation (ST27). When the cumulative load is calculated from the simulation results, the cumulative load calculation means 13 acquires the operating time and transmission speed from the simulation results stored in the simulation results database 18. On the other hand, when the cumulative load is calculated on the basis of the actual operating conditions, the cumulative load calculation means 13 acquires the operating time and transmission speed from the operation information stored in the operating results database 21.

Thereafter, the cumulative load calculation means 13 calculates the cumulative value of the transmission speed (ST73) and stores the relationship between the operating time and the cumulative value of the transmission speed (ST74). The storage means 17, for example, can be used as the storage destination.

The cumulative load calculation means 13 judges whether all the data of the processing target have been analyzed (ST75) and repeats steps ST72 to ST75 until all the target data have been processed. As a result, the relationship between the cumulative load (cumulative transmission speed) and the operating time can be found for the transmission of a certain dump truck.

Figure 23:
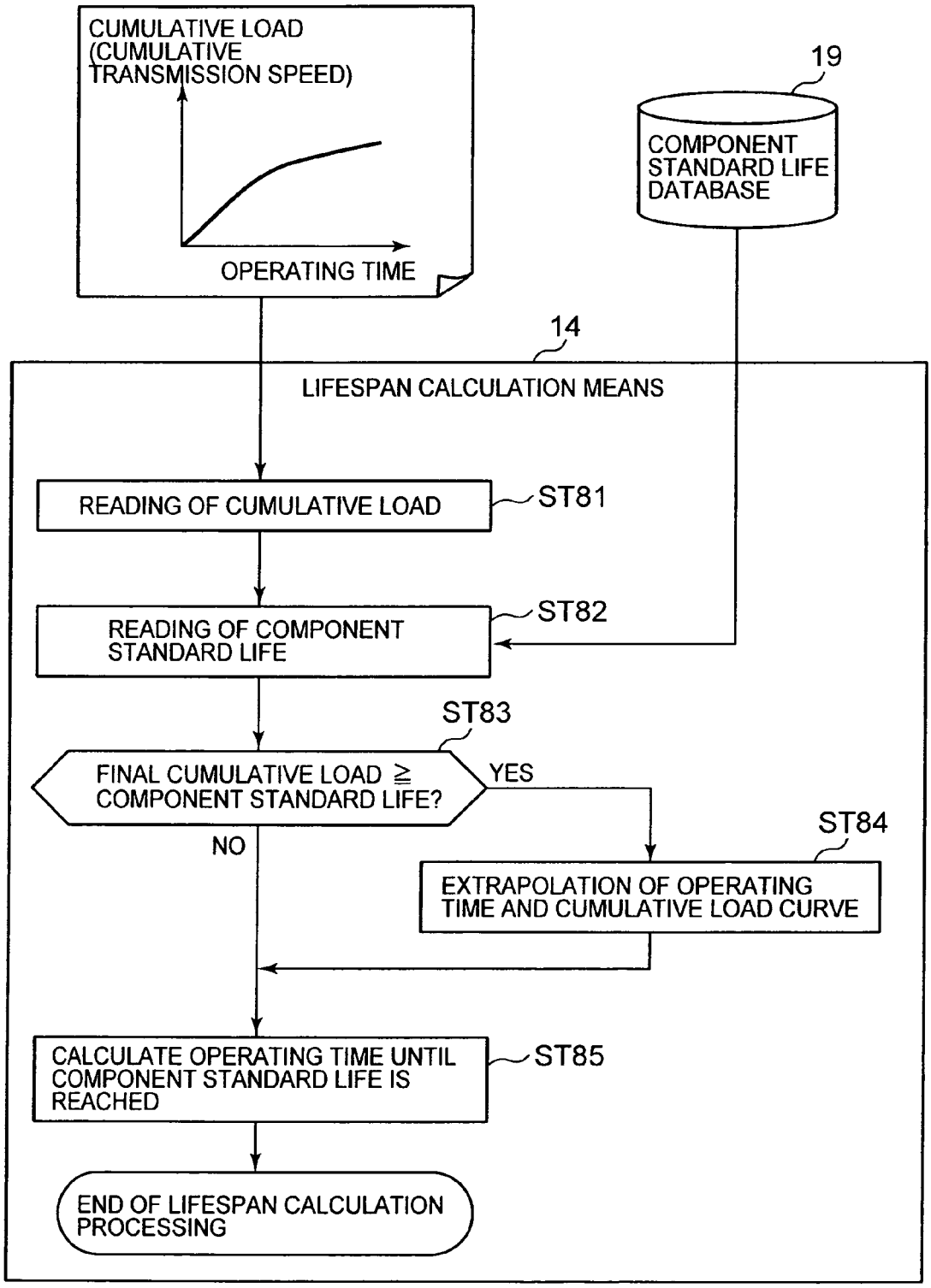
FIG. 23 shows the constitution of the lifespan calculation means.

FIG. 23 is an explanatory diagram of a constitutional example of the lifespan calculation means 14. First, the lifespan calculation means 14 reads the relationship between the cumulative load output by the cumulative load calculation means 13 and the operating time (ST81) and reads the component standard life associated with the transmission from the component standard lifespan database 19 (ST82). The component standard life of the transmission is set as the 'count value'. That is, the dimensions of the cumulative load and the dimensions of the component standard life match.

The lifespan calculation means 14 compares the final cumulative load relating to the transmission (value acquired by ST81) with the component standard life and judges whether the cumulative load is equal to or more than the component standard life (ST83). When the cumulative load of the transmission is equal to or more than the value of the component standard life of the transmission (ST83: YES), the lifespan calculation means 14 extrapolates the characteristic line of the operating time and cumulative load as shown in FIG. 24 (ST84).

Figure 24:
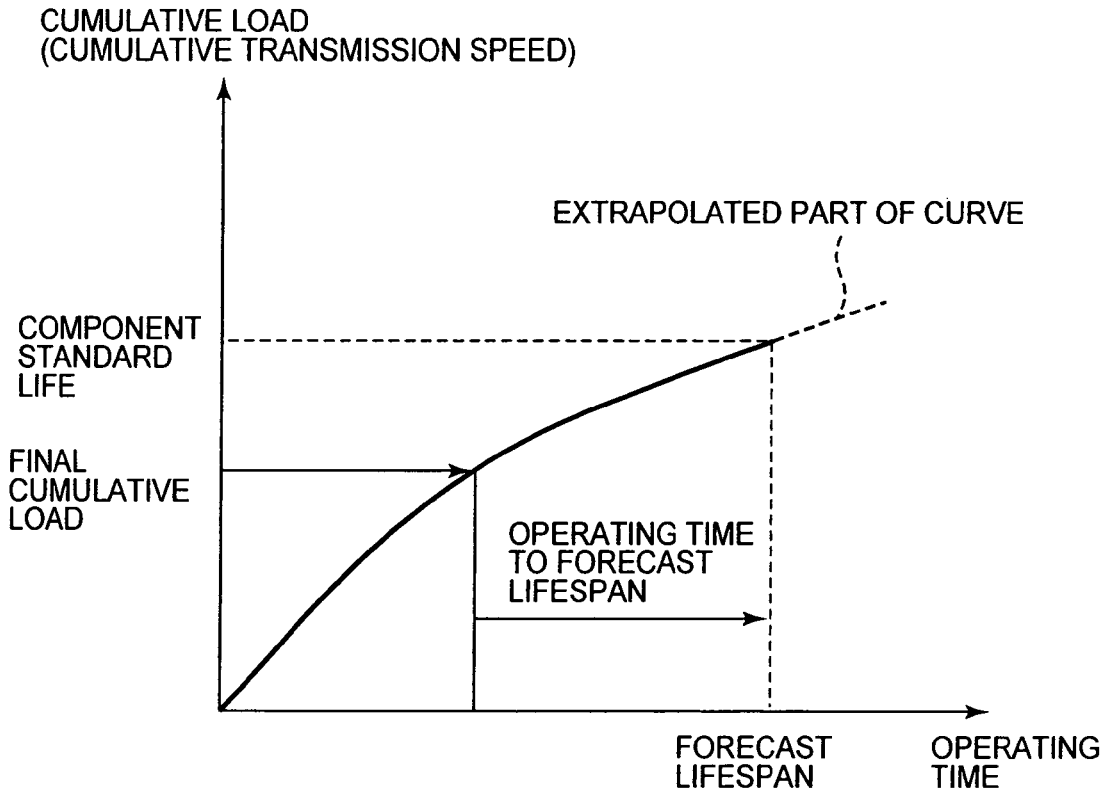
FIG. 24 is a characteristic diagram showing the relationship between the cumulative load and the operating time.

When the cumulative load of the transmission is less than the component standard life (ST83:NO), the lifespan calculation means 14 calculates the operating time until the current cumulative load reaches the value shown in the component standard life as shown in FIG. 24 (ST85).

Figure 25:
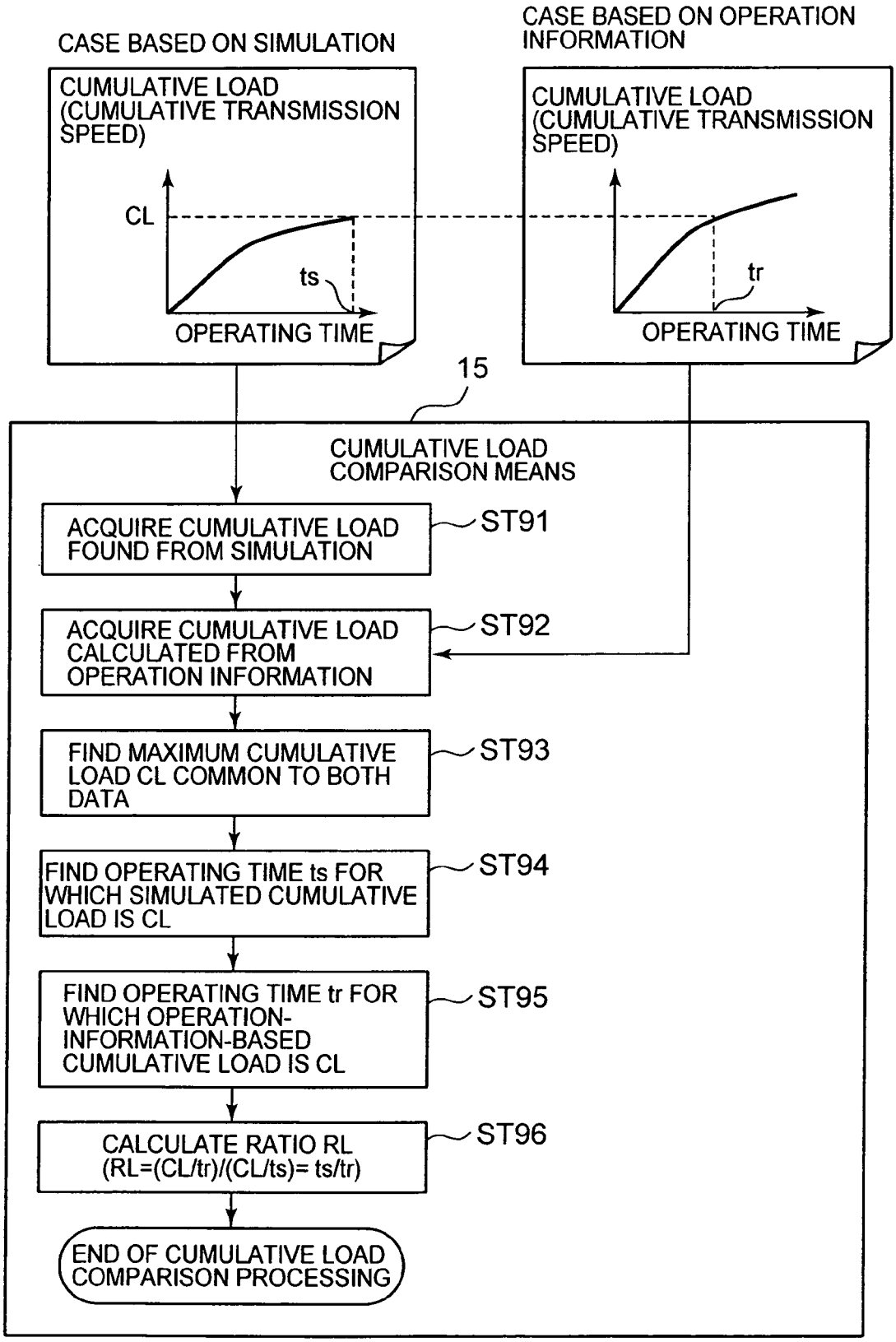
FIG. 25 shows the constitution of cumulative load comparison means.

FIG. 25 is an explanatory diagram of a constitutional example of the cumulative load comparison means 15. As mentioned earlier, in this embodiment, the cumulative load (severity) is calculated for both the simulation result performed under the conditions provided previously and the actual operating conditions of the respective construction machines 3.

Because cumulative loads of a plurality of types that differ in origin can be calculated, cases can be found where the values differ even for cumulative loads relating to the same component. Causes of differences between the cumulative loads can include, for example, cases where the accuracy of the production operating conditions set in the simulation model is low and cases where the value of the coefficients of the calculation algorithm used by the cumulative load calculation means 13 have not been set at the optimum values.

The cumulative load comparison means 15 acquires a forecast cumulative load based on the simulation results (ST91) and acquires the actual cumulative load based on the operation information (ST92). Thereafter, the cumulative load comparison means 15 finds a maximum value CL common to both cumulative loads (ST93). Thereafter, the cumulative load comparison means 15 finds the operating time ts when the forecast cumulative load has the common maximum value CL (ST94) and the operating time tr when the actual cumulative load has the common maximum value CL (ST95).

Further, the cumulative load comparison means 15 calculates the correction ratio RL (RL=(CL/tr)/(CL/ts)=ts/tr) on the basis of the respective operating times ts and tr (ST96). The ratio RL indicates that the actual cumulative load has a larger RL multiple than the forecast cumulative load. This means that, the larger RL becomes, the more the construction machine 3 that comprises the component is used under conditions that are stricter than the assumed usage conditions in a normal state.

Further, the characteristic line between the cumulative load and operating time is not actually a straight line and defines a curve. However, in this embodiment, a case where the ratio RL was found easily by means of the average gradient was mentioned by way of example. The method of finding the ratio RL is not limited to this method and the difference between the two cumulative loads may be calculated more accurately. However, as per this embodiment, by finding the ratio RL easily by viewing the characteristic line of the cumulative load and operating time as a straight line, the ratio RL can be found easily. Therefore, even in cases where a multiplicity of construction machines 3 that each comprise a plurality of maintenance target components exist, for example, the correction ratio RL can be found in a relatively short time.

Figure 26:
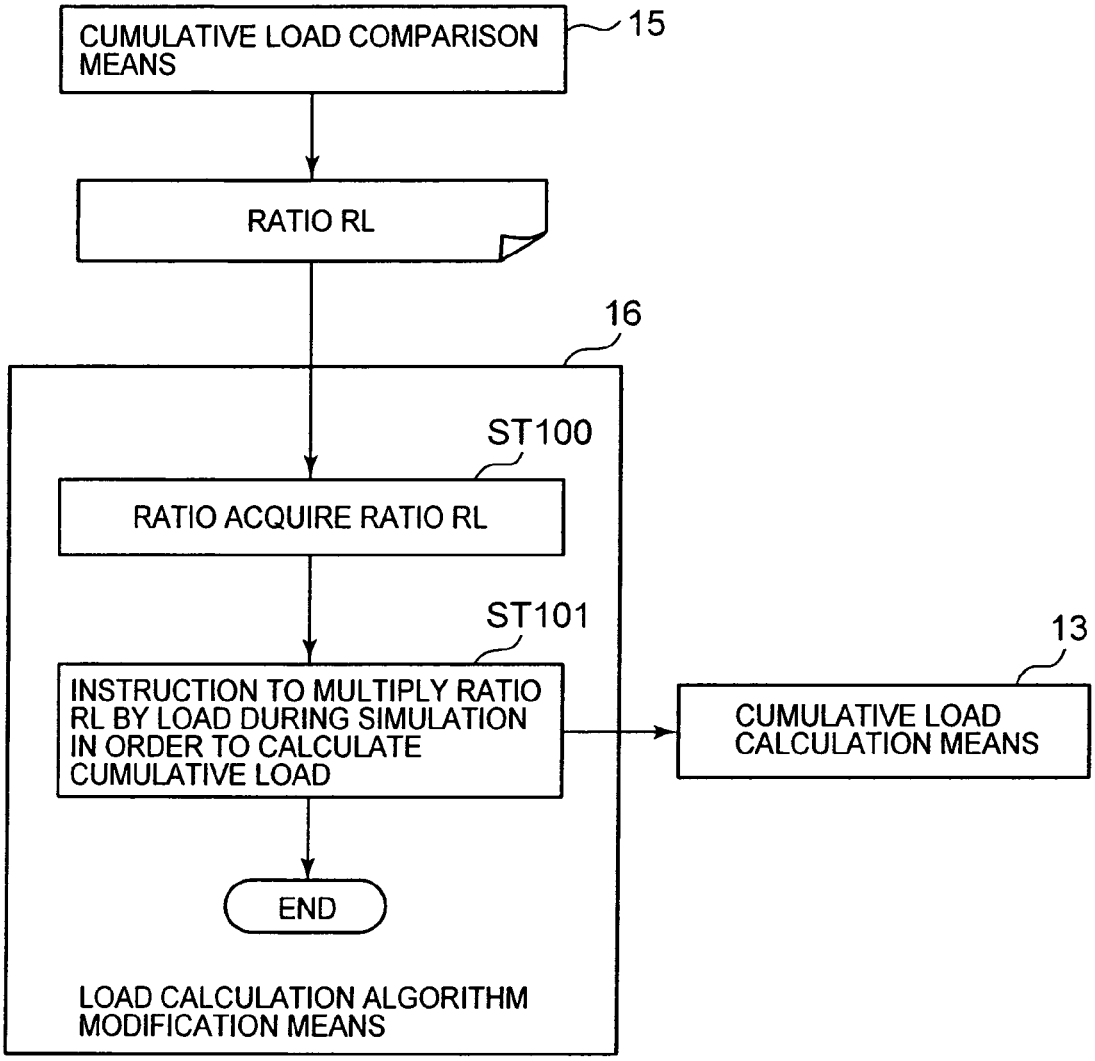
FIG. 26 shows the constitution of load calculation algorithm modification means.

FIG. 26 is an explanatory diagram showing a constitutional example of the load calculation algorithm modification means 16. The load calculation algorithm modification means 16 acquires the ratio RL calculated by the cumulative load comparison means 15 (ST100). The load calculation algorithm modification means 16 then sets the cumulative load calculation means 13 so that the cumulative load is calculated by multiplying the load obtained from the simulation by the ratio RL (ST101).

Third Embodiment

Figure 27:
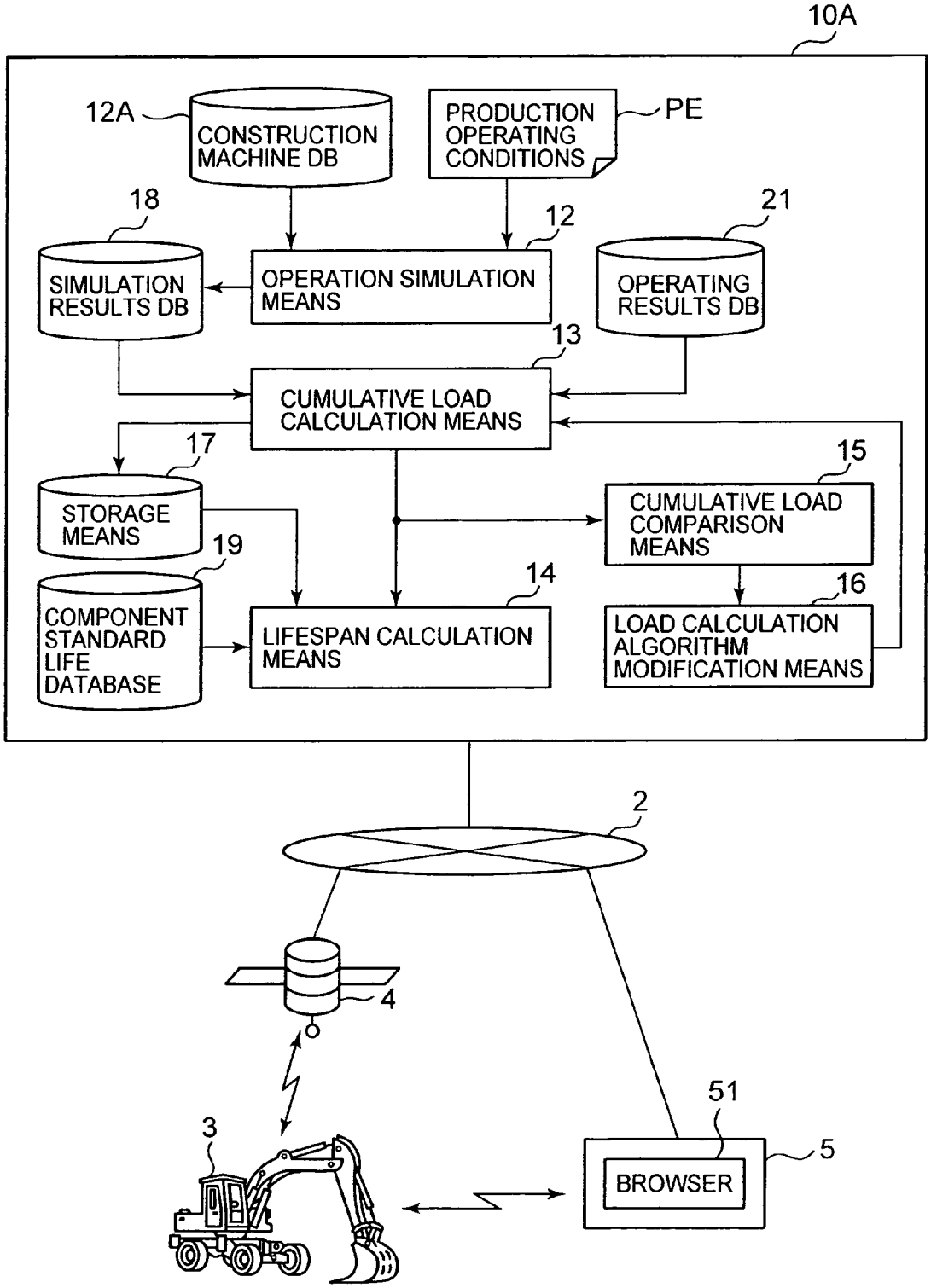
FIG. 27 is a block diagram showing another constitutional example of the maintenance support system for a construction machine.

FIG. 27 is a block diagram showing another constitutional example of the system of the present invention. In this example, the computer 10A is constituted as a server and a response is sent back in accordance with a request from another computer terminal 5.

The computer terminal 5 is a client terminal that is operated by the sales engineer of the construction machine manufacturer or sales agency or by a maintenance personnel or the like, for example. The terminal 5 can be connected to the server computer 10A via the communication network 2. The terminal 5 has a web browser 51 installed thereon, for example, and exchanges information with the server computer 10A via the web browser 51. For example, a mobile terminal such as a cellular phone, a Personal Digital Assistant (PDA), or handheld computer can be used as the client terminal 5.

Further, in this embodiment, a case where a large amount of maintenance support processing is processed by the server computer 10A is cited by way of example. However, the present embodiment is not limited to such a case. For example, a constitution in which one or a plurality of plug-in software is installed in the web browser 51 and maintenance processing is processed cooperatively by the server computer 10A and terminal 5 is also possible.

The server computer 10A is communicably connected to the respective construction machines 3 and the terminal 5 via the communication network 2. The server computer 10A can be constituted comprising the operation simulation means 12, cumulative load calculation means 13, lifespan calculation means 14, cumulative load comparison means 15, load calculation algorithm modification means 16, storage means 17, simulation results database (abbreviated to 'DB' in FIG. 27) 18, component standard lifespan database 19, operating results database 21, and construction machine database 12A, for example.

Further, the server computer 10A needs not be a single computer and may also be constructed by implementing cooperation between a plurality of server computers.

The server computer 10A simulates the behavior of a construction machine group on the basis of the production operating conditions thus input and forecasts each of the cumulative loads for a plurality of components that the respective construction machines 3 comprise. Further, the server computer 10A calculates the actual cumulative load on the basis of the operating information collected from the respective construction machines 3. The server computer 10A then forecasts the lifespan of the maintenance target components. The server computer 10A is able to automatically improve the forecast accuracy by autonomously correcting the cumulative load calculation algorithm.

The terminal 5 is able to perform a simulation by inputting production operating conditions to the server computer 10A, for example, by accessing the server computer 10A via the communication network 2. Information such as the forecast lifespan based on the simulation results is transmitted via the communication network 2 from the server computer 10A to the terminal 5. Terminal 5 is also able to obtain information on the cumulative load and so forth based on the operation information from the server computer 10A by accessing the server computer 10A.

Maintenance of the database is also straightforward because various databases 12A, 18, 19, and 21 for performing the component lifespan forecasts and so forth are centrally managed by the server computer 10A.

Further, the present invention is not limited to the above embodiment and includes other constitutions and so forth that allow the object of the present invention to be achieved. The modifications and so forth that appear hereinbelow are also included in the present invention.

For example, in the component recommendation system 1 of this embodiment, the computer terminal 10 comprises the operation simulation means 12 which computes the severity of the components at a stage at or before to mine development and allows an accurate maintenance schedule to be established by calculating the lifespan of the components. However, cases where the operation simulation means 12 is not provided are also included in the present invention. That is, this is because a more accurate component lifespan can be calculated simply by calculating the severity of a component on the basis of operation information that is based on the driving and working conditions of the actual construction machine 3 and, if the maintenance schedule is updated on the basis of the more accurate component lifespan as occasion calls, the maintenance schedule can be made more accurate.

However, because providing the operation simulation means 12 has the effect of allowing a more accurate maintenance contract for an accurate maintenance schedule to be tied up, the operation simulation means 12 is desirably provided.

Conversely, the cumulative load calculation means 13 of this embodiment is provided with the ability to compute both the severity corresponding with the simulation results and the severity based on the actual operation information. However, cases where only the severity corresponding with the simulation results can be calculated are also included in the present invention. In such cases also, because a maintenance schedule that is sufficiently accurate in comparison with a conventional maintenance schedule can be established, the arrangement and exchange and so forth of components can be performed before a component develops an anomaly.

However, because the severity is calculated based on the actual operation information, even when the severity found by the simulation differs for any reason, the maintenance schedule can be reviewed in accordance with the previous severity and arrangement and conversion and so forth can be performed before an anomaly of the component occurs. Hence, the severity is desirably provided so that same can be calculated on the basis of the operation information.

An embodiment was described by taking mine development as an example in this embodiment. However, the system of the present invention is not limited to mine development and may be applied to a construction machine that operates in an optional site such as a construction site or civil engineering site. The site of operation needs not be overseas, and the construction machines are not limited to loaders, hydraulic shovels, and dump trucks and may be any construction machine such as bulldozers, graders, and crushers.

INDUSTRIAL APPLICABILITY

The maintenance support system for a construction machine of the present invention can be applied a variety of construction machines that operate on a site that involves the transportation of replacement components.

The invention claimed is:

1. A maintenance support system for a construction machine that comprises a computer system that is connected to the construction machine via a communication network, wherein the computer system comprises:

an operation simulation means for simulating driving conditions and/or working conditions of the construction machine prior to the operation of the construction machine on the basis of production operating conditions that are input;

a cumulative load calculation means for calculating a cumulative load relating to a predetermined component that is preset, on the basis of simulation results produced by the operation simulation means; and a lifespan calculation means for calculating a lifespan of the predetermined component on the basis of the cumulative load thus calculated, wherein the operation simulation means sets, for respective simulation models, a departure point of the construction machine, an arrival point of the construction machine, and at least one course that links the departure and the arrival points, each being designated by a production operating condition, in order to simulate, at predetermined times, driving conditions and/or working conditions of the construction machine in accordance with occurrence status of events associated with the departure point, the arrival point, and the course respectively.

2. The maintenance support system for a construction machine according to claim 1, wherein the operation simulation means sets a plurality of event nodes on the course, and produces events for the respective event nodes in consideration of traffic regulations and traffic amounts between the respective event nodes.

3. A maintenance support system for a construction machine that comprises a computer system that is connected to the construction machine via a communication network, wherein the computer system comprises:

a cumulative load calculation means for calculating a cumulative load relating to a predetermined component that is preset, on the basis of operation information that is acquired from the construction machine via the communication network; and a lifespan calculation means for calculating a lifespan of the predetermined component on the basis of the cumulative load thus calculated;

an operation simulation means for simulating driving conditions and/or working conditions of the construction machine on the basis of production operating conditions that are input;

the cumulative load calculation means is capable of calculating, by means of a predetermined calculation algorithm, the cumulative load of the predetermined component, on the basis of simulation results produced by the operation simulation means or the operation information;

a cumulative load comparison means for comparing the cumulative load based on the simulation results and the cumulative load based on the operation information; and a load calculation algorithm modification means for changing the calculation algorithm on the basis of a result of the comparison by the cumulative load comparison means.

4. The maintenance support system for a construction machine according to claim 3, wherein the operation simulation means sets, for respective simulation models, a departure point of the construction machine, an arrival point of the construction machine, and at least one course that links the departure and the arrival points, each being designated by a production operating condition, in order to simulate, at predetermined times, driving conditions and/or working conditions of the construction machine in accordance with occurrence status of events associated with the departure point, the arrival point, and the course respectively.

5. The maintenance support system for a construction machine according to claim 4, wherein the operation simulation means sets a plurality of event nodes on the course, and produces events for the respective event nodes in consideration of traffic regulations and traffic amounts between the respective event nodes.

6. The maintenance support system for a construction machine according to any one of claim 1 or 3, wherein the cumulative load calculation means calculates relationship between the cumulative load and operation time relating to the predetermined component.

7. The maintenance support system for a construction machine according to any one of claim 1 or 3, wherein the lifespan calculation means predictively calculates the lifespan of the predetermined component on the basis of a standard lifespan that is preset for the predetermined component and a result of the calculation by the cumulative load calculation means.

8. The maintenance support system for a construction machine according to claim 3, wherein the cumulative load calculation means calculates relationship between the cumulative load and operating time relating to the predetermined component;

the cumulative load comparison means finds a maximum value of the cumulative load based on the simulation results and a maximum value of the cumulative load based on the operation information, detects respective operating times corresponding with the maximum values, and calculates and outputs a ratio between the respective operating times thus detected;

the load calculation algorithm modification means corrects the calculation algorithm on the basis of the ratio between the respective operating times calculated by the cumulative load comparison means.

9. A maintenance support system for construction machines that comprises a plurality of construction machines, each of which is connected to a communication network and a computer system that is connected to the communication network, wherein respective construction machines comprise:

a plurality of sensors for detecting operating states of respective components;

an operation information generation section for statistically processing information that is detected by the respective sensors and outputting the information as operation information; and a communication section for transmitting the operation information output from the operation information generation section to the computer system via the communication network, wherein the computer system comprises:

an operation information database that accumulates the operation information that is received from the communication section via the communication network;

a component standard lifespan database in which standard lifespan of the respective components are accumulated beforehand;

a simulation results database for accumulating simulation results;

an input section for inputting production operating conditions of the respective construction machines;

an operation simulation section for individually simulating driving conditions and/or working conditions of the respective construction machines by setting the production operating conditions input via the input section in the simulation model, and storing simulation results in the simulation results database;

a cumulative load calculation section for calculating, in accordance with a predetermined calculation algorithm, a cumulative load relating to the respective components on the basis of the operation information stored in the operating information database and a cumulative load relating to the respective components on the basis of the simulation results stored in the simulation results database;

a lifespan calculation section for calculating lifespan of the respective components on the basis of the cumulative loads thus calculated and the component standard life database;

a cumulative load comparison section for comparing the cumulative load calculated on the basis of the simulation results and the cumulative load calculated on the basis of the operation information; and a load calculation algorithm modification section for modifying the calculation algorithm on the basis of the result of the comparison by the cumulative load comparison section.

* * * * *